US006644059B2

(12) United States Patent
Maeda et al.

(10) Patent No.: US 6,644,059 B2
(45) Date of Patent: Nov. 11, 2003

(54) DEHUMIDIFYING APPARATUS

(75) Inventors: Kensaku Maeda, Kanagawa (JP); Shunro Nishiwaki, Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/275,988

(22) PCT Filed: May 16, 2001

(86) PCT No.: PCT/JP01/04072

§ 371 (c)(1),
(2), (4) Date: Nov. 20, 2002

(87) PCT Pub. No.: WO02/093081

PCT Pub. Date: Nov. 21, 2002

(65) Prior Publication Data

US 2003/0136140 A1 Jul. 24, 2003

(51) Int. Cl.[7] ..... F25D 23/00

(52) U.S. Cl. ..... 62/271; 62/94; 62/92; 62/238.2; 62/324.1

(58) Field of Search ..... 62/271, 94, 238.3, 62/92, 324.1

(56) References Cited

U.S. PATENT DOCUMENTS

| | | | | | |
|---|---|---|---|---|---|
| 4,103,509 | A | * | 8/1978 | Bottum | 62/238 |
| 4,184,338 | A | * | 1/1980 | Bennett | 62/2 |
| 4,607,498 | A | * | 8/1986 | Dinh | 62/185 |
| 5,613,372 | A | * | 3/1997 | Beal et al. | 62/434 |
| 5,953,926 | A | * | 9/1999 | Dressler et al. | 62/175 |
| 6,021,644 | A | * | 2/2000 | Ares et al. | 62/151 |
| 6,199,389 | B1 | | 3/2001 | Maeda | |
| 6,212,892 | B1 | * | 4/2001 | Rafalovich | 62/90 |
| 6,247,323 | B1 | | 6/2001 | Maeda | |
| 6,318,106 | B1 | * | 11/2001 | Maeda | 62/271 |
| 6,487,872 | B1 | * | 12/2002 | Forkosh et al. | 62/271 |
| 6,494,053 | B1 | * | 12/2002 | Forkosh et al. | 62/271 |
| 6,546,746 | B2 | * | 4/2003 | Forkosh et al. | 62/271 |

FOREIGN PATENT DOCUMENTS

| | | |
|---|---|---|
| JP | 10-288421 | 10/1998 |
| JP | 10-288486 | 10/1998 |
| JP | 2000-356481 | 12/2000 |
| JP | 2001-162131 | 6/2001 |
| JP | 2001-215030 | 8/2001 |
| WO | WO98/46957 | 10/1998 |
| WO | WO98/46958 | 10/1998 |

* cited by examiner

*Primary Examiner*—William C. Doerrler
*Assistant Examiner*—Mark S. Shulman
(74) *Attorney, Agent, or Firm*—Armstrong, Westerman & Hattori, LLP.

(57) ABSTRACT

A dehumidifying apparatus capable of continuously supplying dry air having an absolute humidity of 4 g/kgDA or lower is provided. The dehumidifying apparatus has a moisture adsorbing device for removing moisture from process air and for being regenerated by desorbing moisture therefrom with regeneration air B, and a heat pump having a condenser for condensing a refrigerant to heat the regeneration air at the upstream side of the moisture adsorbing device, an evaporator for evaporating the refrigerant to cool the regeneration air to a temperature equal to or lower than its dew point at the downstream side of the moisture adsorbing device, a pressurizer for raising a pressure of the refrigerant evaporated by the evaporator and delivering the refrigerant to the condenser, and a heat exchanger for exchanging heat between the regeneration air flowing between the moisture adsorbing device and the evaporator and the regeneration air flowing between the evaporator and the condenser, wherein said regeneration air is used in circulation. Since moisture is removed from the process air by the moisture adsorbing device, it is possible to obtain air having a low dew point equal to or lower than an freezing point, i.e., a low absolute humidity of 4 g/kgDA or lower.

8 Claims, 17 Drawing Sheets

(a)

viewed in a direction
represented by an arrow A (b)

DEHUMIDIFYING APPARATUS

TECHNICAL FIELD

The present invention relates to a dehumidifying apparatus, and more particularly to a dehumidifying apparatus having a high moisture removal.

BACKGROUND ART

As shown in FIG. 17, there has heretofore been available a dehumidifying apparatus 11 having a compressor 1 for compressing a refrigerant C, a condenser 2 for condensing the compressed refrigerant C to heat process air A, an evaporator 3 for depressurizing the condensed refrigerant C with an expansion valve 5 and evaporating the refrigerant to cool the process air A to a temperature equal to or lower than its dew point. The evaporator 3 cools the process air A from an air-conditioned space 10 to a temperature equal to or lower than its dew point to remove moisture from the process air A, the condenser 2 heats the process air A which has been cooled to a temperature equal to or lower than its dew point, and the heated process air A is supplied to the air-conditioned space 10. With the illustrated dehumidifying apparatus 11, a heat pump HP is constituted by the compressor 1, the condenser 2, the expansion valve 5, and the evaporator 3. The heat pump HP pumps heat from the process air A which flows through the evaporator 3 into the process air A which flows through the condenser 2.

The conventional dehumidifying apparatus 11 having the heat pump HP cannot supply dry air having an absolute humidity of 4 g/kgDA or lower. The reason is that since the operating temperature of the evaporator 3 in the heat pump HP is equal to or lower than the freezing point, the removed moisture is deposited as frost on the heat transfer surface to inhibit the heat transfer, and hence the apparatus cannot continuously be operated.

It is therefore an object of the present invention to provide a dehumidifying apparatus which can prevent moisture removed from air from being deposited as frost on a heat transfer surface of an evaporator in a heat pump to continuously supply dry air having an absolute humidity of 4 g/kgDA or lower.

DISCLOSURE OF INVENTION

To achieve the above object, according to an aspect of the present invention, as shown in FIG. 1, for example, there is provided a dehumidifying apparatus comprising: a moisture adsorbing device 103 for removing moisture from process air A and for being regenerated by desorbing moisture therefrom with regeneration air B; and a heat pump HP1 having a condenser 220 for condensing a refrigerant C to heat said regeneration air B at the upstream side of said moisture adsorbing device 103, an evaporator 210 for evaporating said refrigerant C to cool said regeneration air B to a temperature equal to or lower than its dew point at the downstream side of said moisture adsorbing device 103, a pressurizer 260 for raising a pressure of said refrigerant C evaporated by said evaporator 210 and delivering said refrigerant C to said condenser 220, and a first heat exchanger 300 for exchanging heat between said regeneration air B flowing between said moisture adsorbing device 103 and said evaporator 210 and the regeneration air B flowing between said evaporator 210 and said condenser 220; wherein said regeneration air B is used in circulation.

With the above arrangement, since the dehumidifying apparatus has the condenser, the evaporator, and the first heat exchanger, the regeneration air is circulated such that it is heated by the condenser, regenerates the moisture adsorbing device to increase the amount of moisture contained in the regeneration air, is cooled by the first heat exchanger, is cooled and condensed by the evaporator to reduce the amount of moisture contained in the regeneration air, and is heated by the first heat exchanger. When the regeneration air is cooled by the first heat exchanger, the moisture thereof may partly be condensed, reducing the amount of moisture contained in the regeneration air. The regeneration air is cooled (precooled) by the first heat exchanger prior to cooling in the evaporator, and is heated (preheated) by the heat exchanger after cooling by the evaporator. Therefore, the dehumidifying apparatus can be operated at a low sensible heat factor.

Since the moisture of the process air is adsorbed by the moisture adsorbing device, the humidity of the process air is greatly reduced, and hence dry air can be supplied. The expression that the regeneration air is used in circulation means that after having regenerated the moisture adsorbing device, e.g., the desiccant of a desiccant wheel, the regeneration air flows a circulating circuit so that most of the regeneration air can be used again as regeneration air, without being discharged directly into the atmosphere (no regeneration air may be discharged into the atmosphere, or part of regeneration air may be discharged into the atmosphere).

In the first heat exchanger, the refrigerant is evaporated and condensed typically under an intermediate pressure between the condensing pressure in the condenser and the evaporating pressure in the evaporator.

In the dehumidifying apparatus, the first heat exchanger 300 may comprise a thin pipe group connecting the condenser 220 and the evaporator 210 to each other, for passing the refrigerant therethrough; wherein the thin pipe group may be arranged so as to introduce the refrigerant condensed by the condenser 220 to the evaporator 210 and also to bring said refrigerant into alternate contact with the regeneration air flowing between the moisture adsorbing device 103 and the evaporator 210 and the regeneration air flowing between the evaporator 210 and the condenser 220.

With the above arrangement, since the thin pipe group into which the refrigerant is introduced is brought into alternate contact with the regeneration air flowing between the moisture adsorbing device and the evaporator and the regeneration air flowing between the evaporator and the condenser, heat exchange between these two flows of the regeneration air can be performed by the refrigerant. The connection between the condenser and the evaporator includes indirectly connecting the condenser and the evaporator with a pipe, a pipe joint, or the like.

In the dehumidifying apparatus, as shown in FIG. 1, for example, the first heat exchanger 300 may have a first compartment 310 for passing the regeneration air between the moisture adsorbing device 103 and the evaporator 210, and a second compartment 320 for passing the regeneration air between the evaporator 210 and the condenser 220, the thin pipe group being connected to the condenser 220 through a first restriction 330, extending alternately through the first compartment 310 and the second compartment 320 repeatedly, and then being connected to the evaporator 210 through a second restriction 250.

With the above arrangement, since the dehumidifying apparatus has the first restriction and the second restriction, while the refrigerant is passing through the first restriction and the second restriction, the refrigerant develops a pressure drop across each of the first restriction and the second restriction. The refrigerant passing through the first compartment is evaporated and the refrigerant passing through the second compartment is condensed under an intermediate pressure between the condensing pressure of the refrigerant in the condenser and the evaporating pressure of the refrigerant in the evaporator. Therefore, the heat exchanger acts as an economizer, and the coefficient of performance (COP) of the heat pump is increased.

As shown in FIG. 13, for example, the dehumidifying apparatus may have a plurality of thin pipe groups 51 (52, 53) connected to the condenser 220 through first restrictions 331*a* (332*a*, 333*a*) and alternatively extending through the first compartment 310 and the second compartment 320 repeatedly and then connected to the evaporator 210 through corresponding second restrictions 331*b* (332*b*, 333*b*), and a plurality of combinations of the first restrictions 331*a*, 332*a*, 333*a* and the second restrictions 331*b*, 332*b*, 333*b* which correspond respectively tothe thin pipe groups 51, 52, 53. As shown in FIG. 13, the first compartment 310 and the second compartment 320 should preferably be arranged such that the regeneration air flows as counterflows in the respective compartments 310, 320.

In the dehumidifying apparatus, as shown in FIG. 8, for example, the first compartment 310 and the second compartment 320 may be arranged such that the regeneration air flows as counterflows in the respective compartments 310, 320; and the thin pipe groups in the first compartment 310 and the second compartment 320 may have at least a pair of a first compartment extending portion 251B and a second compartment extending portion 252B in a first plane PB which is substantially perpendicular to the flows of the regeneration air, at least a pair of a first compartment extending portion 251C and a second compartment extending portions 252C in a second plane PC, different from the first plane PB, which is substantially perpendicular to the flows of the regeneration air, and an intermediate restriction 331 disposed in a transitional location from the first plane PB to the second plane PC.

With the above arrangement, from the viewpoint of heat exchange between the flows of the regeneration air, a high heat exchange efficiency is achieved because heat exchange can be performed between counterflows. The thin pipe groups have at least a pair of a first compartment extending portion and a second compartment extending portion in the first plane to form a pair of refrigerant paths, and at least a pair of a first compartment extending portion and a second compartment extending portion in the second plane, different from the first plane, which is substantially perpendicular to the flows of the regeneration air, to form a pair of refrigerant paths. Therefore, the heat exchanger can be constructed in a small compact size as a whole. Since the thin pipe groups also have an intermediate restriction disposed in a transitional location from the first plane to the second plane, the pressure of evaporation or condensation in the first and second compartment extending portions in the second plane can be of a value lower than the pressure of evaporation or condensation in the first and second compartment extending portions in the first plane. Accordingly, the heat exchange between the flows of the regeneration air flowing through the respective compartments can be made similar to counterflow heat exchange, thus increasing the heat exchange efficiency. The first plane and the second plane typically comprise rectangular planes.

As shown in FIG. 1, for example, the dehumidifying apparatus may have a second heat exchanger 340 disposed in the passage of the regeneration air used in circulation, for exchanging heat between the regeneration air and another fluid.

With the above arrangement, the second heat exchanger is capable of exchanging heat between the regeneration air and the other fluid for cooling or heating the regeneration air. The second heat exchanger typically cools the regeneration air.

As shown in FIG. 6, for example, the second heat exchanger 340*a* comprises a second thin pipe group connecting the condenser 220 and the first heat exchanger 300 to each other, for passing the refrigerant therethrough, and the second thin pipe group is arranged so as to introduce the refrigerant condensed by the condenser 220 to the first heat exchanger 300 and also to bring the refrigerant into alternate contact with the regeneration air flowing between the moisture adsorbing device 103 and the first heat exchanger 300 and the other fluid.

With the above arrangement, the second heat exchanger is capable of exchanging heat between the regeneration air and the other fluid via the refrigerant.

The other fluid should preferably comprise external air. With this arrangement, the excessive amount of heat of the regeneration air can be discharged into external air which is an almost unlimited source of heat.

The present application is based on Japanese patent application No. 2000-025811 filed on Feb. 3, 2000, which is incorporated herein as part of the disclosure of the present application.

The present invention can more fully be understood based on the following detailed description. Further applications of the present invention will become more apparent from the following detailed description. However, the following detailed description and specific examples will be described as preferred embodiments only for the purpose of explaining the present invention. It is evident to a person skilled in the art that various changes and modifications can be made to the embodiments in the following detailed description within the spirit and scope of the present invention.

The applicant has no intention to dedicate any of the embodiments described below to the public, and any of the disclosed modifications and alternatives which may not be included in the scope of the claims constitutes part of the invention under the doctrine of equivalent.

DESCRIPTION OF THE REFERENCE NUMERALS AND SIGNS

Figure 1:
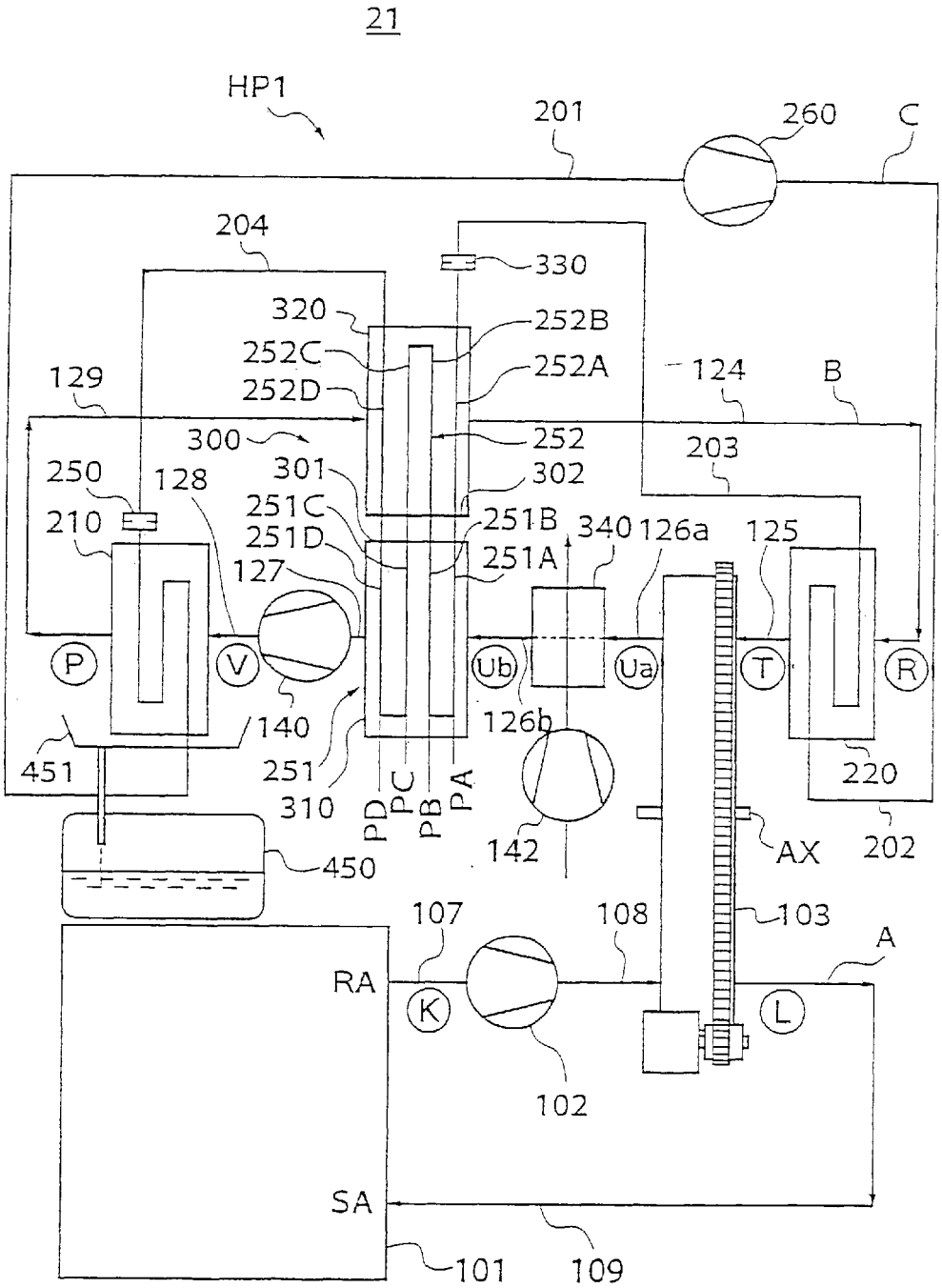
FIG. 1 is a flow diagram of a dehumidifying apparatus according to a first embodiment of the present invention.

21, 22, 23 dehumidifying apparatus
101 air-conditioned space
103 desiccant wheel
102, 140 air blower
210 evaporator
220 condenser
251, 251A, 251B, 251C, 251D, 251E evaporating section
252, 252A, 252B, 252C, 252D, 252E condensing section
250 restriction
260 compressor
300, 300*b*, 300*c*, 300*d*, 300*e* heat exchanger
310 first compartment
320 second compartment
330 restriction
331, 332 intermediate restriction
340, 340*a* heat exchanger
HP1, HP2, HP3, HP4 heat pump
PA, PB, PC, PD, PE plane

BEST MODE FOR CARRYING OUT THE INVENTION

Embodiments of the present invention will be described below with reference to the accompanying drawings. Identical or corresponding parts are denoted by identical or like reference characters throughout drawings, and will not be described repetitively.

Figure 2:
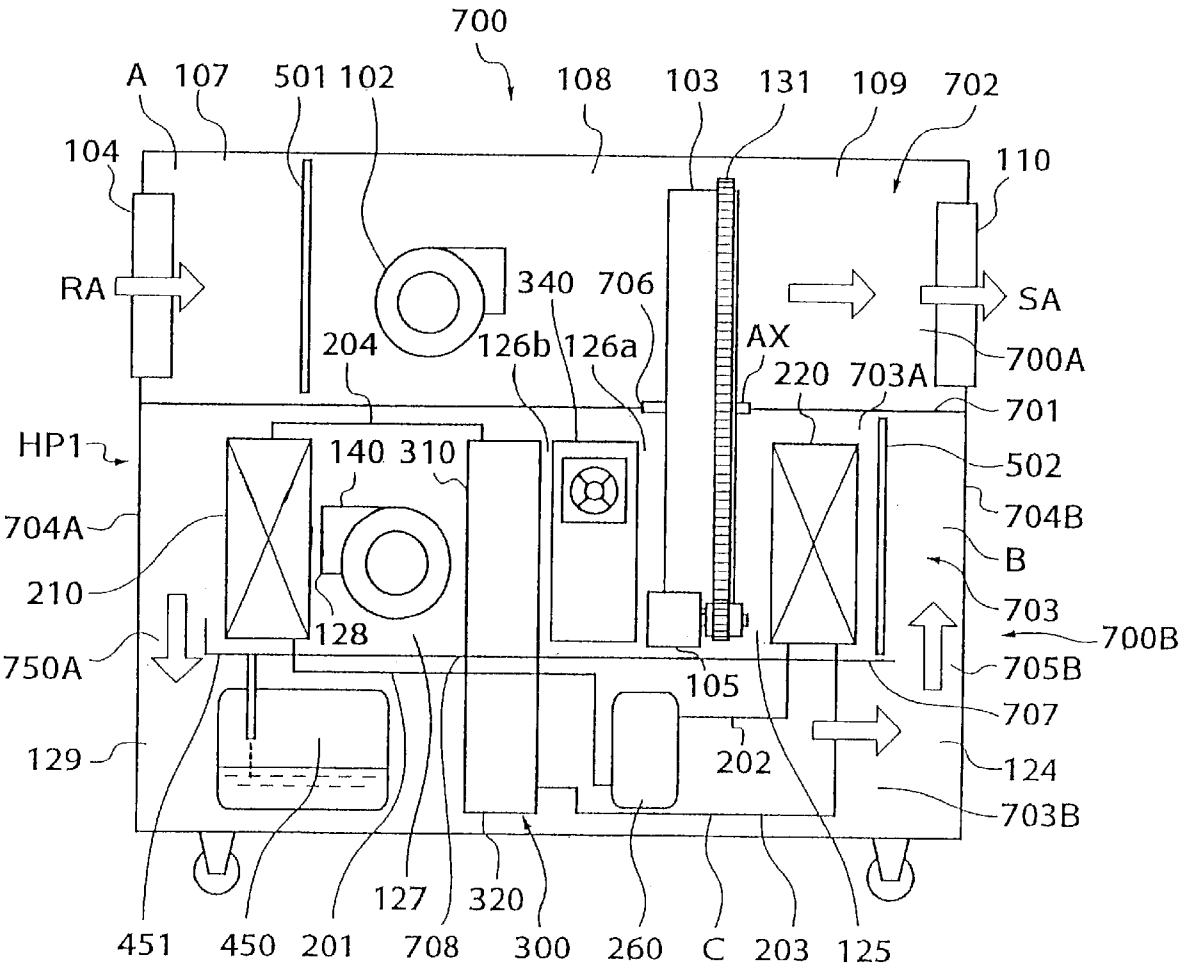
FIG. 2 is a cross-sectional front view schematically showing a structure of the dehumidifying apparatus shown in FIG. 1.
Figure 3:
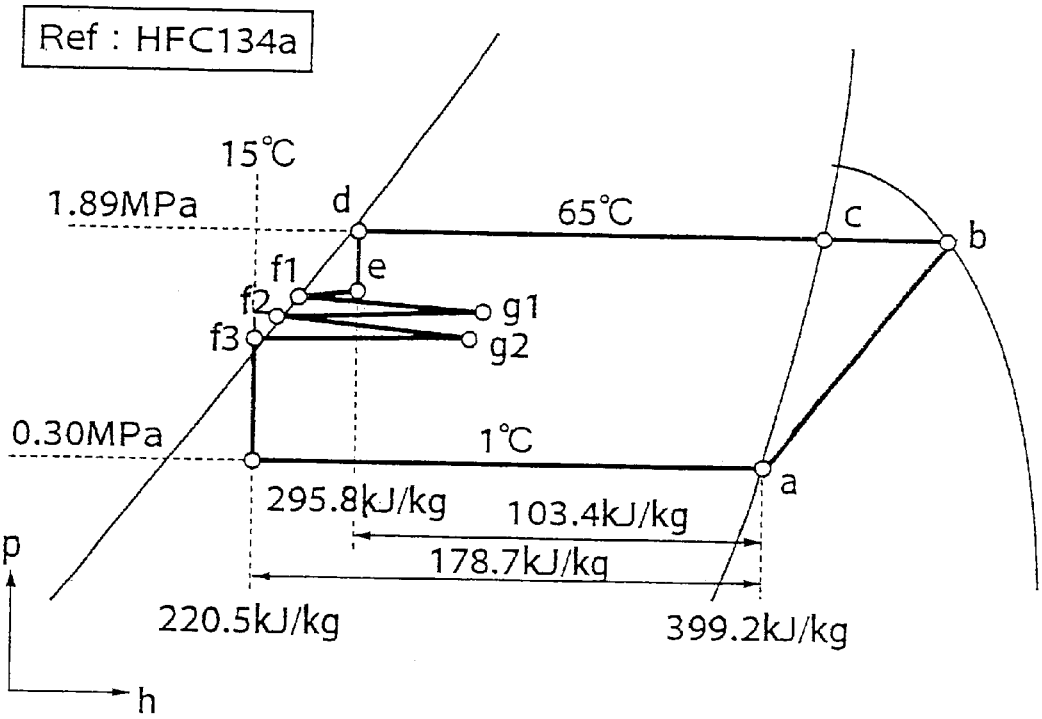
FIG. 3 is a Mollier diagram of a heat pump of the dehumidifying apparatus shown in FIG. 1.
Figure 4:
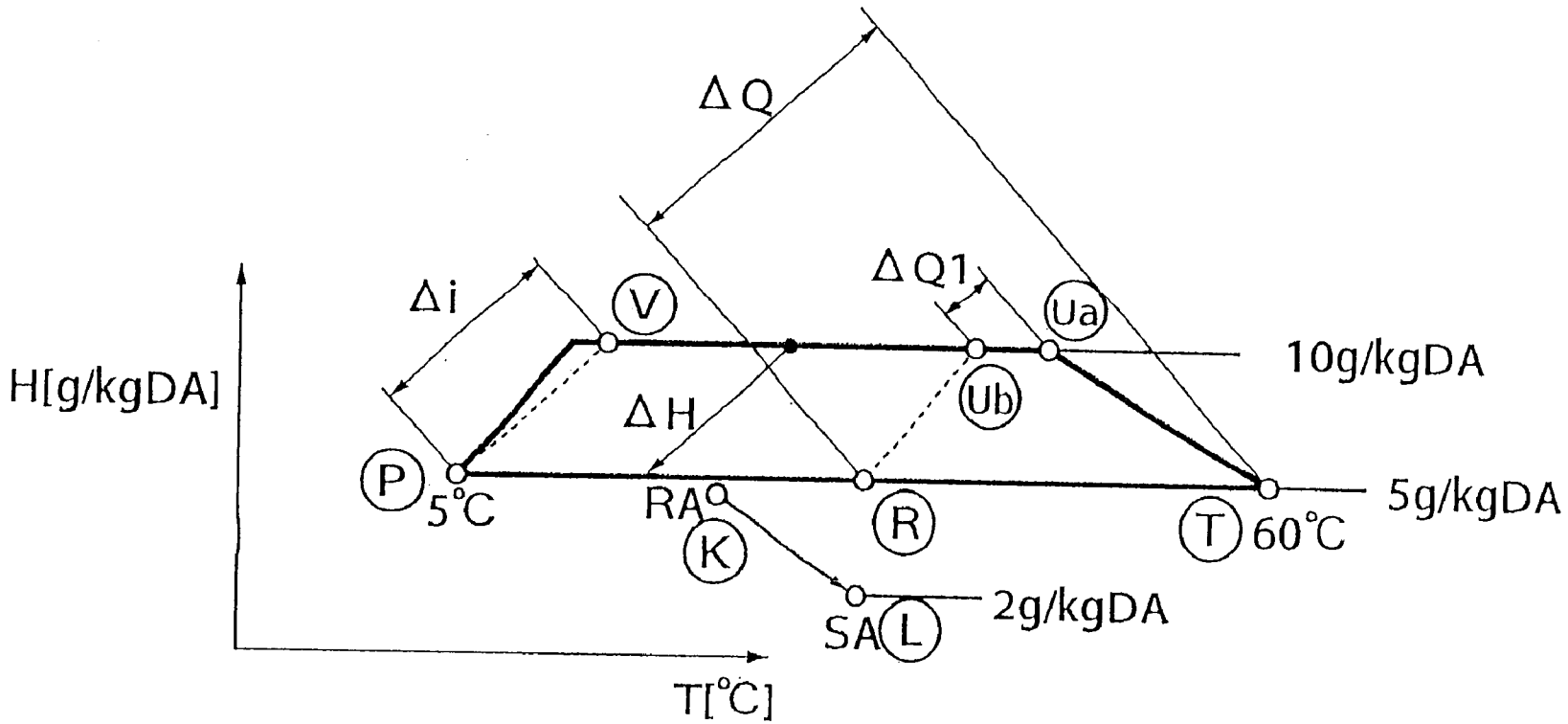
FIG. 4 is a psychrometric chart illustrative of operation of the dehumidifying apparatus shown in FIG. 1.

FIG. 1 is a flow diagram of a dehumidifying apparatus 21 according to a first embodiment of the present invention. The dehumidifying apparatus 21 circulates regeneration air B to regenerate a desiccant and dehumidifies process air A with use of the desiccant. FIG. 2 is a cross-sectional front view of the dehumidifying apparatus 21 shown in FIG. 1. FIG. 3 is a refrigerant Mollier diagram of a heat pump HP1 included in the dehumidifying apparatus 21 shown in FIG. 1, and FIG. 4 is a psychrometric chart of the dehumidifying apparatus 21 shown in FIG. 1.

Structural details of the dehumidifying apparatus 21 according to the first embodiment will be described below with reference to FIG. 1. The dehumidifying apparatus 21 cools the regeneration air B which has regenerated the desiccant to a temperature equal to or lower than its dew point to condense the moisture in the regeneration air B into water and collect the condensed water, and dehumidifies the process air A with the regenerated desiccant to keep an air-conditioned space 101 which is supplied with the process air A at a low humidity level.

In FIG. 1, devices related to the process air will be described along a path for the process air A from the air-conditioned space 101. A path 107 connected to the air-conditioned space 101, an air blower 102 for circulating the process air A, a path 108, a desiccant wheel 103 filled with a desiccant for adsorbing the moisture of the process air A that passes therethrough to lower the humidity of the process air A, and a path 109 are arranged in the order named so as to return the process air A from the path 109 to the air-conditioned space. The paths 107 through 109 connect the devices mentioned before the respective paths 107 through 109 to the devices mentioned after the respective paths 107 through 109. The desiccant wheel 103 serves as a moisture adsorbing device according to the present invention.

Devices related to the regeneration air will be described below along a path of the regeneration air B.

A second compartment 320 of a heat exchanger 300 serving as an economizer of the heat pump HP1, a path 124, a condenser 220, a path 125, the desiccant wheel 103 filled with the desiccant which is regenerated by the regeneration air B passing therethrough, a path 126*a*, a second heat exchanger 340 for exchanging heat between external air as another fluid and the regeneration air B, a path 126*b*, a first compartment 310 of a first heat exchanger 300, a path 127, an air blower 140 for circulating the regeneration air B, a path 128, an evaporator 210 for cooling the regeneration air B to a temperature equal to or lower than its dew point to condense the moisture in the regeneration air B into water and collect the condensed water, and a path 129 are arranged in the order named so as to return the regeneration air B from the path 129 to the second compartment 320 of the heat exchanger 300 and to circulate the regeneration air B. Since the regeneration air B is not required to be discharged out of the circulating system and highly humid air is not discharged into an indoor space (air-conditioned space 101), the dehumidifying apparatus 21 is not limited to any installation area and may be mobile.

The paths 124 through 129 connect the devices mentioned before the respective paths 124 through 129 to the devices mentioned after the respective paths 124 through 129. The moisture in the regeneration air B which has been condensed by the evaporator 210 is collected by a drain pan 451 disposed vertically below the evaporator 210, and then accumulated in a drain tank 450.

Devices of the heat pump HP1 for moving (pumping) heat with use of a refrigerant C will be described below along the path of the refrigerant C.

An evaporator 210 for heating the refrigerant C with the regeneration air to evaporate the refrigerant C, a path 201, a compressor 260 serving as a pressurizer according to the present invention for compressing the refrigerant C that has been evaporated into a vapor by the evaporator 210, a path 202, a condenser 220 for cooling the refrigerant C with the regeneration air to condense the refrigerant C, a path 203 having a restriction 330 disposed thereon, a condensing section 252 for heating the regeneration air B which flows through the second compartment 320 of the first heat exchanger 300, an evaporating section 251 for cooling the regeneration air B which flows through the first compartment 310 of the first heat exchanger 300, and a path 204 having a restriction 250 disposed thereon are arranged in the order named so as to return the refrigerant C to the evaporator 210. The paths 201 through 204 connect the devices mentioned before the respective paths 201 through 204 to the devices mentioned after the respective paths 201 through 204.

The desiccant wheel 130 will be described later in detail with reference to FIG. 16.

Next, referring to FIG. 1, structural details of the heat exchanger 300 will be described below. The heat exchanger 300 comprises a heat exchanger for performing heat exchange between the regeneration air B flowing into the evaporator 210 and the regeneration air B flowing out of the evaporator 210, indirectly with the refrigerant C. The heat exchanger 300 has a plurality of substantially parallel heat exchange tubes as refrigerant paths or tubules in each of a plurality of different planes PA, PB, PC, PD which lie perpendicularly to the sheet of FIG. 1 and also to the flow of the regeneration air B (four planes are illustrated in FIG. 1, but the number of planes is not limited thereto). In FIG. 1, only one tube is shown in each of the above planes for simple illustration.

The heat exchanger 300 has the first compartment 310 for allowing the regeneration air B before flowing through the evaporator 210 to pass therethrough, and the second compartment 320 for allowing the regeneration air B after flowing through the evaporator 210 to pass therethrough. The first compartment 310 and the second compartment 320 form respective separate spaces, each in the form of a rectangular parallelepiped. Both of the compartments have partition walls 301, 302 disposed adjacent to each other, respectively, and the heat exchange tubes extend through these two partition walls 301, 302.

Figure 5:
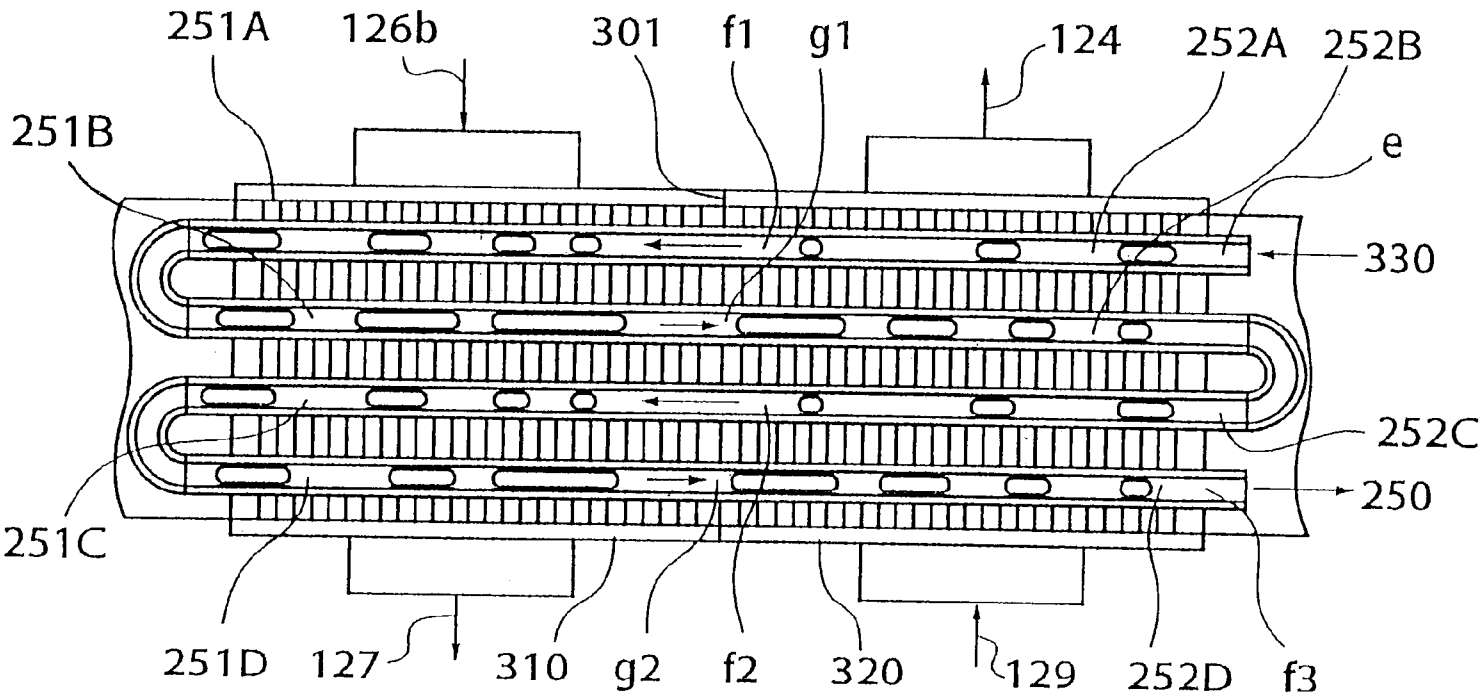
FIG. 5 is a schematic cross-sectional view illustrative of a behavior of a refrigerant in a first heat exchanger and a second heat exchanger used in the first embodiment of the present invention.
Figure 12:
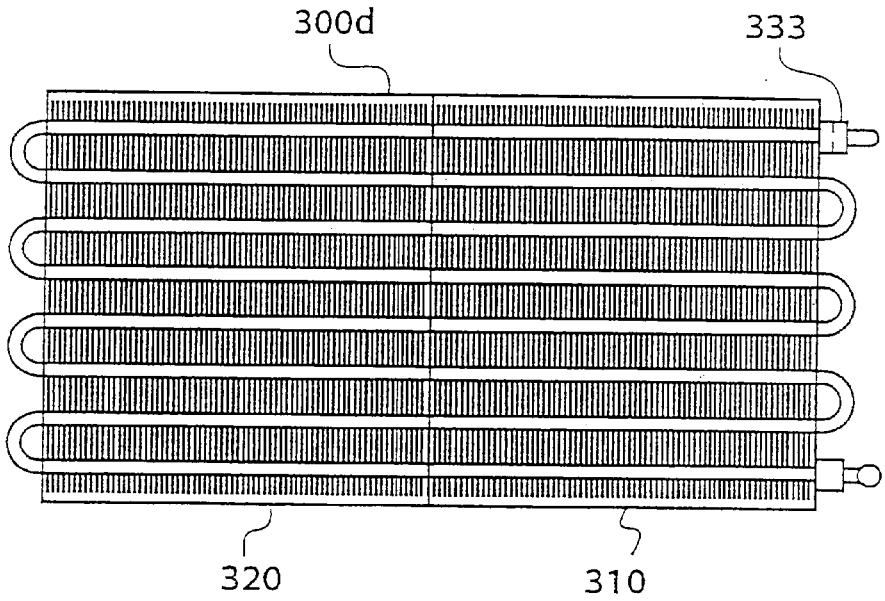
FIGS. 12(*a*) and 12(*b*) are cross-sectional plan and side elevational views, respectively, of a heat exchanger suitable for use in the heat pump of the dehumidifying apparatus according to the embodiment of the present invention.
Figure 12:
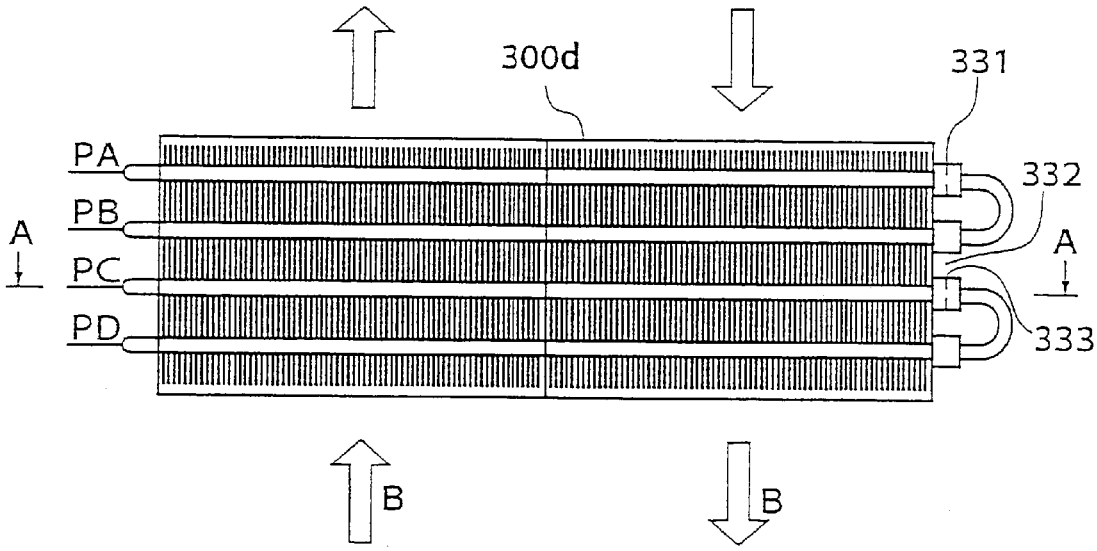

In an other embodiment, the he at exchanger 300 may be constructed such that a single space in the form of a rectangular parallelepiped is divided by a single partition wall and the heat exchange tubes as a group of thin pipes extend through the partition wall and alternatively through the first compartment and the second compartment (see FIGS. 5, 12(*a*) and 12(*b*)).

The regeneration air B which has flowed from the desiccant wheel 103 passes from the right in FIG. 1 through the path 126*a* into the heat exchanger 340, is precooled in the heat exchanger 340, is supplied through the path 126*b* into the first compartment 310 of the heat exchanger 300, and then flows out of the heat exchanger 300 from the left in FIG. 1 through the path 127. On the other hand, the regeneration air B which has passed through the evaporator 210 and has been cooled to a temperature equal to or lower than its dew point with the lowered absolute humidity is supplied from the left in FIG. 1 through the path 129 into the second compartment 320 of the heat exchanger 300, and then flows out of the heat exchanger 300 from the right side of the second compartment 320 of the heat exchanger 300 through the path 124.

As shown in FIG. 1, the above heat exchange tubes extend through the first compartment 310, the second compartment 320, and the partition walls 301, 302 which separate those compartments from each other. The heat exchange tubes disposed in the plane PA, for example, have portions extending through the first compartment 310, and such portions are referred to as an evaporating section 251A (hereinafter simply referred to as an evaporating section 251 in the case where it is not necessary to discuss a plurality of evaporating sections separately). The heat exchange tubes disposed in the plane PA also have portions extending through the second compartment 320, and such portions are referred to as a condensing section 252A (hereinafter simply referred to as a condensing section 252 in the case where it is not necessary to discuss a plurality of condensing sections separately). The evaporating section 251A and the condensing section 252A serve as a pair of first and second compartment extending portions, and constitute refrigerant paths.

Further, the heat exchange tubes disposed in the plane PB have portions extending through the first compartment 310, and such portions are referred to as an evaporating section 251B. The heat exchange tubes disposed in the plane PB also have portions extending through the second compartment 320, and such portions, which constitute a pair of refrigerant paths with the evaporating section 251B, are referred to as a condensing section 252B. Refrigerant paths are also provided in each of the planes PC, . . . as with the plane PB.

As shown in FIG. 1, the evaporating section 251A and the condensing section 252A are paired with each other and formed by a single tube as an integral passage. This feature, together with the fact that the first compartment 310 and the second compartment 320 are positioned adjacent to each other with the two partition walls 301, 302 being interposed therebetween, is effective in making the heat exchanger 300 small and compact as a whole.

In the heat exchanger shown in FIG. 1 according to the present embodiment, the evaporating sections 251A, 251B, 251C, . . . as the first compartment extending portions are successively arranged in the order named from the right in FIG. 1, and the condensing sections 252A, 252B, 252C, . . . the second compartment extending portions are also successively arranged in the order named from the right in FIG. 1.

Further, as shown in FIG. 1, the end of the evaporating section 251A (remote from the partition wall 301) and the end of the evaporating section 251B (remote from the partition wall 301) are connected to each other by a U tube. The end of the condensing section 252B and the end of the condensing section 252C are similarly connected to each other by a U tube.

Therefore, the refrigerant C flowing in one direction from the condensing section 252A through the evaporating section 251A is introduced into the evaporating section 251B via the U tube, and then flows into the condensing section 252B, from which the refrigerant flows into the condensing section 252C via the U tube. In this manner, the refrigerant paths including the evaporating sections and the condensing sections extend alternately repetitively through the first compartment 310 and the second compartment 320. In other words, the refrigerant paths are provided as a group of meandering thin pipes. A group of meandering thin pipes pass through the first compartment 310 and the second compartment 320, and are held in alternate contact with the regeneration air B which has a higher temperature and the regeneration air B which has a lower temperature.

While the refrigerant from the restriction 330 is first introduced into the condensing section 252A in the present embodiment, the refrigerant may first be introduced into the evaporating section 251A. According to such a modification, the end of the condensing section 252A (remote from the partition wall 302) and the end of the condensing section 252B (remote from the partition wall 302) are connected to each other by a U tube, and the end of the evaporating section 251B and the end of the evaporating section 251C are similarly connected to each other by a U tube.

Next, flows of the refrigerant C between the devices will be described below with reference to FIG. 1.

In FIG. 1, a refrigerant vapor C compressed by the refrigerant compressor 260 is introduced into the refrigerant condenser 220 via the refrigerant vapor pipe 202 connected to the discharge port of the compressor 260. The refrigerant vapor C compressed by the compressor 260 is cooled and condensed by the regeneration air B as cooling air immediately before flowing into the desiccant wheel 103, to thus heat the regeneration air B.

The condenser 220 has a refrigerant outlet connected by the refrigerant passage 203 to the inlet of the condensing section 252A in the heat exchanger 300. The restriction 330 is disposed on the refrigerant path 203 near the inlet of the condensing section 252A.

The refrigerant liquid C that flows out of the condenser 220 is depressurized by the restriction 330 and expanded so as to be partly evaporated (flashed). The refrigerant C which is a mixture of the liquid and the vapor reaches the condensing section 252A, where the refrigerant liquid C flows so as to wet the inner wall surface of the tube in the condensing section 252A. The flushed refrigerant is cooled and condensed by the cooled regeneration air B immediately after it has flowed out of the evaporator 210. When the refrigerant is thus condensed, the regeneration air B flowing through the second compartment 320, i.e., the regeneration air B which has been cooled and dehumidified by the evaporator 210 to a temperature lower than the temperature of the regeneration air before flowing into the evaporator 210, is heated (preheated).

The condensing section 252A and the evaporating section 251A are constructed as a continuous tube. Specifically, since the condensing section 252A and the evaporating section 251A are provided as an integral passage, the condensed refrigerant liquid C (and the refrigerant liquid C which has not been condensed) flows into the evaporating section 251A. The refrigerant C is then heated and evaporated by the regeneration air B which has flowed out of the desiccant wheel 103 and has been cooled to a certain extent in the heat exchanger 340, thus further cooling (precooling) the regeneration air B flowing through the first compartment 310. This regeneration air B is the regeneration air B before flowing into the evaporator 210.

As described above, the heat exchanger 300 has the evaporating section as the refrigerant path extending through the first compartment 310 and the condensing section as the refrigerant path extending through the second compartment 320 (at least one pair of them, e.g., denoted by 251A and 252A) in the first plane PA, and also has the condensing section as the refrigerant path extending through the second compartment 320 and the evaporating section as the refrigerant path extending through the first compartment 310 (at least one pair of them, e.g., denoted by 252B and 251B) in the second plane PB.

The outlet of the final condensing section 252D in the heat exchanger 300 is connected to the evaporator 210 via the refrigerant liquid pipe 204, and the expansion valve 250 is disposed as a restriction on the refrigerant pipe 204.

The refrigerant liquid C condensed in the condensing section 252 is depressurized and expanded by the restriction 250 to lower its temperature. Then, the refrigerant liquid enters the refrigerant evaporator 210 and is evaporated to cool the regeneration air B with heat of evaporation. The restrictions 330, 250 may comprise orifices, capillary tubes, expansion valves, or the like.

The refrigerant C which has been evaporated into a vapor in the evaporator 210 is introduced into the suction side of the refrigerant compressor 260 through the path 201, and thus the above cycle is repeated. In this manner, the heat pump HP1 pumps heat from low-temperature regeneration air as a low-temperature heat source to high-temperature regeneration air as a high-temperature heat source.

The dehumidifying apparatus 21 simultaneously regenerates the desiccant and removes moisture from the regeneration air, with the heat pump HP1, and preheats the regeneration air B before regenerating the desiccant and precools the regeneration air B after regenerating the desiccant, with the internal operating medium. Therefore, the dehumidifying apparatus 21 is simple in structure, and has a high moisture removal as most of the cooling effect of the heat pump can be used to condense the moisture in the air.

When the air is to be cooled and dehumidified, if the air is cooled directly to its dew point, then the amount of cooling is large. Therefore, a considerable portion of the cooling effect of the heat pump is consumed to cool the air, so that the moisture removal (dehumidifying performance) per electric power consumption is low. For this reason, the air-to-air heat exchanger 300 is provided across the evaporator 210 to precool and reheat (preheat) the regeneration air B, thereby reducing the sensible heat factor and reducing the amount of cooling down to the dew point.

In addition to providing a high moisture removal, the dehumidifying apparatus 21 can recover the heat to cool to the dew point for use as the heat to heat the regeneration air. Therefore, the desiccant can perform the moisture removal with a small amount of electric power. Since the amount of heat required is smaller than the amount of heat needed by a conventional electric heater, and the heat pump HP1 has a high energy efficiency, the electric power consumption of the dehumidifying apparatus is small.

A mechanical arrangement of the dehumidifying apparatus 21 described above will be described below with reference to FIG. 2. In FIG. 2, devices of the dehumidifying apparatus are housed in a cabinet 700. The cabinet 700 comprises a housing of thin steel sheets in the form of a rectangular parallelepiped, and is divided into an upper region 700A and a lower region 700B which are located vertically with respect to each other and sealed from each other, by a horizontal flat partition plate 701. The upper region 700A defines a process air chamber 702 through which the process air A flows from the left-hand end to the right-hand end thereof. The lower region 700B primarily defines a regeneration air chamber 703 in which the regeneration air B is circulated as described later. The lower region 700B includes a space positioned away from the regeneration air chamber 703 for housing the compressor 260 and the drain tank 450. The partition plate 701 may comprise a thin steel sheet which is similar to those of the cabinet 700.

The arrangement of devices in the process air chamber 702 will first be described below. An air inlet port 104 is opened in a vertically uppermost portion of a left side panel 704A of the cabinet 700, for drawing the process air A from the air-conditioned space 101 (see FIG. 1). The air inlet port 104 is an opening of the process air chamber 702, so that the process air A drawn from the air inlet port 104 flows through the process air chamber 702. A filter 501 is provided near the air inlet port 104 of the process air chamber 702 for preventing dust in the air-conditioned space 101 from entering the dehumidifying apparatus. The air blower 102 is disposed inwardly of the filter 501, and the process air A flowing from the air inlet port 104 through the filter 501 into the process air chamber 702 is drawn by the air blower 102.

The path 107 is defined between the air inlet port 104 and the air blower 102. The process air A is caused to flow through the process air chamber 702 by the air blower 102.

The process air A discharged from the air blower 102 flows through the path 108, flows horizontally into an upper half of the desiccant wheel 103, and is dehumidified by the desiccant of the desiccant wheel 103. The process air A which has flowed horizontally from the upper half of the desiccant wheel 103 passes through the path 109, flows out of the process air chamber 702 (i.e., flows out of the cabinet 700) from an outlet port 110 which is opened in an vertically uppermost portion of a right side panel 704B of the cabinet 700, and is returned and supplied to the air-conditioned space 101.

The desiccant wheel 103 extends through an opening 706 defined in the partition plate 701 with its rotational axis AX being horizontally oriented. The desiccant wheel 103 has a semicircular upper half disposed in the process air chamber 702 and a semicircular lower half disposed in the an upper region 703A, described later, of the regeneration air chamber 703. An electric motor 105 as an actuator is disposed near the desiccant wheel 103 in the upper region 703A, described later, of the process air chamber 703 with its rotational axis being horizontally oriented. The electric motor 105 and the desiccant wheel 103 are operatively connected to each other by a chain 131, which transmits the rotation of the electric motor 105 to the desiccant wheel 103 to rotate the desiccant wheel 103 at a rotational speed ranging from 15 to 20 revolutions per hour. Since the rotational axis AX of the desiccant wheel 103 is oriented horizontally, the cabinet 700 can be constructed in a compact size with its horizontal length being reduced.

The height of the process air chamber 702 is slightly larger than the radius of the desiccant wheel 103, and the height of the regeneration air chamber 703 is slightly smaller than twice the radius of the desiccant wheel 103. The regeneration air chamber 703 has a horizontal flat partition plate 707 disposed therein which is spaced downwardly from the partition plate 701 by a distance slightly larger than the radius of the desiccant wheel 103. The partition plate 707 divides the regeneration air chamber 703 into vertically spaced upper and lower regions 703A, 703B. The partition plate 707 has openings 705A, 705B defined respectively in its opposite ends, for allowing the regeneration air B to circulate in the upper and lower regions 703A, 703B therethrough.

The arrangement of devices in the regeneration air chamber 703 will be described below. A filter 502 is disposed in a right-hand portion of the upper region 703A of the regeneration air chamber 703, for removing dust from the regeneration air B which flows upwardly from the lower region 703B through the right opening 705B and then flows horizontally. The condenser 220 having a coiled heat exchange tube is disposed on the left-hand side of the filter 502. The regeneration air B which has passed through the filter 502 passes through the condenser 220, and is heated thereby. The regeneration air B which has passed through the condenser 220 and the path 125 flows horizontally into the lower half of the desiccant wheel 103, thus regenerating the desiccant. The regeneration air B which has flowed horizontally out of the lower half of the desiccant wheel 103 flows through the path 126*a* into the heat exchanger 340, and is cooled thereby. The regeneration air B which has passed through the heat exchanger 340 and the path 126*b* flows into the first compartment 310 of the heat exchanger 300, and is precooled thereby.

External air as another fluid is introduced into the heat exchanger 340 through a duct (not shown). When the cabinet 700 is not installed in the air-conditioned space 101, a duct for introducing external air into the heat exchanger 340 is not required. In this case, air in the environment where the cabinet 700 is installed is used directly as a fluid for exchanging heat with the regeneration air. The heat exchanger 340 may use cooling water instead of external air. When cooling water is to be used, a cooling water supply pipe and a return pipe are connected to the heat exchanger 340.

The arrangement of the heat exchanger 300 will be described below. The heat exchanger 300 extends through an opening 708 defined in the partition plate 707 and is accommodated in the upper and lower regions 703A, 703B of the regeneration air chamber 703. The first compartment 310 of the heat exchanger 300 is disposed in the upper region 703A, and the second compartment 320 of the heat exchanger 300 is disposed in the lower region 703B.

The regeneration air B which has flowed out of the first compartment 310 of the heat exchanger 300 is drawn through the path 127 into the air blower 140 which circulates the regeneration air B in the regeneration air chamber 703. The regeneration air B discharged from the air blower 140 passes through the path 128 which is extremely short and the evaporator 210 having a coiled heat exchange tube, and is cooled by the evaporator 210. While the regeneration air B is then flowing through the path 129, it changes its direction to a vertically downward direction, and passes through the left opening 705A. The regeneration air B which has passed through the opening 705A changes its direction to a horizontal direction, flows horizontally in the lower region 703B of the regeneration air chamber 703, and flows into the second compartment 320 of the heat exchanger 300 where the regeneration air B is preheated. The drain tank 450 and the compressor 260 are disposed in a portion of the regeneration air chamber 703 which is horizontally closer to the viewer of FIG. 2. The regeneration air B which has flowed out of the second compartment 320 of the heat exchanger 300 flows through the path 124, changes its direction to a vertically upward direction, passes through the right opening 705B, then changes its direction to a horizontal direction, and reaches the filter 502. Thereafter, the regeneration air B circulates repeatedly through the above flows.

The arrangement of devices constituting the heat pump HP1 through which the refrigerant C flows will be described below. The compressor 260 and the drain tank 450 are disposed beneath the partition plate 707 away from the lower region 703B of the regeneration air chamber 703. The compressor 260 is disposed substantially directly beneath the desiccant wheel 103 as viewed from the viewer of FIG. 2, and the drain tank 450 is disposed substantially directly beneath the evaporator 210. The paths 201 through 204 are disposed to connect the devices as shown in FIG. 1.

In the above arrangements, the devices are arranged such that the process air A flows horizontally, and the regeneration air B flows mainly horizontally and slightly vertically for circulation. However, the devices may be arranged such that the process air A flows vertically, and the regeneration air B flows mainly vertically and slightly horizontally for circulation.

Next, operation of the heat pump HP1 will be described with reference to FIG. 3. FIG. 3 is a Mollier diagram in the case where HFC134a is used as the refrigerant C. FIG. 1 will be referred to for the description of the devices. In the Mollier diagram, the horizontal axis represents the enthalpy h (kJ/kg), and the vertical axis represents the pressure p (MPa). In addition to the above refrigerant, HFC407C and HFC410A are suitable refrigerants for the heat pump and the dehumidifying air-conditioning apparatus 21 (see FIG. 1) according to the present invention. These refrigerants have an operating pressure region shifted toward a higher pressure side than HFC134a.

In FIG. 3, a point "a" represents a state of the refrigerant at the outlet port of the evaporator 210 shown in FIG. 1, and the refrigerant is in the form of a saturated vapor. The refrigerant has a pressure of 0.30 MPa, a temperature of 1° C., and an enthalpy of 399.2 kJ/kg. A point b represents a state of the vapor drawn and compressed by the compressor 260, i.e., a state at the outlet port of the compressor 260. In the point b, the refrigerant has a pressure of 1.89 MPa and is in the form of a superheated vapor.

The refrigerant vapor C is cooled in the condenser 220 and reaches a state represented by a point c in the Mollier diagram. In the point c, the refrigerant is in the form of a saturated vapor and has a pressure of 1.89 MPa and a temperature of 65° C. Under this pressure, the refrigerant is cooled and condensed to reach a state represented by a point d. In the point d, the refrigerant is in the form of a saturated liquid and has the same pressure and temperature as those in the point c. The saturated liquid has an enthalpy of 295.8 kJ/kg.

The refrigerant liquid C is depressurized by the restriction 330 and flows into the condensing section 252A in the heat exchanger 300. This state is indicated at a point e on the Mollier diagram. The pressure of the refrigerant liquid is an intermediate pressure according to the present invention, i.e., is of an intermediate value between 0.30 MPa and 1.89 MPa in the present embodiment. The intermediate pressure is a saturated pressure at a temperature of 15° C. in the present embodiment. The refrigerant liquid is a mixture of the liquid and the vapor because part of the liquid is evaporated.

In the condensing section 252A, the refrigerant liquid C is condensed under the intermediate pressure, and reaches a state represented by a point f1 on the saturated liquid curve under the intermediate pressure.

The refrigerant C in the state represented by the point f1 flows into the evaporating section 251A. In the evaporating section 251A, the refrigerant C removes heat from the regeneration air B having a relatively high temperature and flowing through the first compartment 310, and is evaporated. The refrigerant C further flows into the evaporating section 251B and reaches a state represented by a point g1, which is located intermediately between the saturated liquid curve and the saturated vapor curve. In the point g1, while part of the liquid is evaporated, the refrigerant liquid C remains in a considerable amount.

The refrigerant C in the state represented by the point g1 flows into the condensing section 252B and then into the condensing section 252C. The refrigerant C is cooled in these condensing sections, increases its liquid phase, reaches a state represented by a point f2 on the saturated liquid curve, and then flows into the evaporating section 251C and then into the evaporating section 251D. In these evaporating sections, the refrigerant C increases its liquid phase, and then reaches a state represented by a point g2. Similarly, the refrigerant C is condensed in the next condensing section 252D and reaches a state represented by a point f3 on the saturated liquid curve. In this manner, while the refrigerant C is being repeatedly condensed and evaporated, it exchanges heat between the regeneration air having a low temperature and the regeneration air having a high temperature. The condensed refrigerant C in the state at the point f3 is then introduced into the expansion valve 250.

On the Mollier diagram, the point f3 is on the saturated liquid curve. In this point, the refrigerant has a temperature of 15° C. and an enthalpy of 220.5 kJ/kg. The refrigerant liquid C at the point f3 is depressurized to 0.30 MPa, which is a saturated pressure at a temperature of 1° C., by the restriction 250, and reaches a state represented by a point j. The refrigerant C at the point j flows as a mixture of the refrigerant liquid C and the vapor at a temperature of 1° C. into the evaporator 210, where the refrigerant removes heat from the process air A and is evaporated into a saturated vapor at the state indicated by the point a on the Mollier diagram. The evaporated vapor is drawn again by the compressor 260, and thus the above cycle is repeated.

When the dehumidifying apparatus is arranged such that the refrigerant at the state e is not evaporated in the evaporating section 251 as in the present embodiment but is first condensed in the condensing section 252, the amount of the refrigerant in a vapor phase which passes through the restriction 250 under volume control is reduced because the refrigerant becomes close to a two-phase state. Therefore, a cooling effect is maintained at a high level.

In the heat exchanger 300, as described above, the refrigerant C goes through changes of the condensed state from the point e to the point f1 or from the point g1 to the point f2 in the condensing section 252, and goes through changes of the evaporated state from the point f1 to the point g1 or from the point f2 to the point g2 in the evaporating section 251. Since the refrigerant transfers heat by way of condensation and evaporation, the rate of heat transfer is very high.

In the vapor compression type heat pump HP1 including the compressor 260, the condenser 220, the restrictions 330, 250, and the evaporator 210, when the heat exchanger 300 is not provided, the refrigerant C at the state represented by the point d in the condenser 220 is returned to the evaporator 210 through the restrictions 250. Therefore, the enthalpy difference that can be used by the evaporator 210 is only 399.2−295.8=103.4 kJ/kg. With the heat pump HP1 according to the present embodiment which has the heat exchanger 300, however, the enthalpy difference that can be used by the evaporator 210 is 399.2−220.5=178.7 kJ/kg. Thus, the amount of vapor that is circulated to the compressor 260 under the same cooling load and the required power can be reduced by 42%. Consequently, the heat pump HP1 according to the present embodiment can perform the same operation as with a subcooled cycle.

Since the refrigerant enthalpy at the inlet of the evaporator 210 is reduced due to the economizer effect of the heat pump and the cooling effect of the refrigerant per unit flow rate is high, the moisture removal effect and the energy efficiency are increased.

Operation of the dehumidifying apparatus 21 having the heat pump HP1 will be described below with reference to a psychrometric chart shown in FIG. 4. FIG. 1 will be referred to for structural details. In FIG. 4, the alphabetical letters K, L, P and R represent states of air in various regions, and correspond to the alphabetical letters which are encircled in the flow diagram shown in FIG. 1. The psychrometric chart shown in FIG. 4 is also applicable to a dehumidifying apparatus according to second and third embodiments of the present invention which will be described later.

In FIG. 1, the process air A (in a state K) from the air-conditioned space 101 is drawn through the process air path 107 into the air blower 102, discharged from the air blower 102, and delivered through the path 108 into the desiccant wheel 103. The process air A from which moisture has been desorbed by the desiccant wheel 103 and hence which has been dried has its absolute humidity lowered to 2 g/kgDA and its dry-bulb temperature increased (state L). The process air A is then returned through the path 109 to the air-conditioned space 101. "DA" in the unit of the absolute humidity stands for Dry Air.

The regeneration air B (in a state P) having an absolute humidity of 5 g/kgDA and a dry-bulb temperature of 5° C., which has flowed out of the evaporator 210, is delivered through the path 129 into the second compartment 320 of the heat exchanger 300. In the second compartment 320, the regeneration air B is heated to a certain extent by the refrigerant C which is condensed in the condensing section 252, to increase its dry-bulb temperature (intermediate between 5° C. and 60° C.) and to keep its absolute humidity constant (state R). This process can be referred to as preheating because the regeneration air B is preliminary heated before being heated by the condenser 220.

The preheated regeneration air B is introduced through the path 124 into the condenser 220. The regeneration air B is heated by the condenser 220 to increase its dry-bulb temperature to 60° C., with constant absolute humidity (state T). The regeneration air B is further delivered through the path 125 into the desiccant wheel 103, where the regeneration air B removes heat from the desiccant (not shown in FIG. 1) in the dry elements, thus regenerating the desiccant. The regeneration air B itself increases its absolute humidity to 10 g/kgDA, and reduces its dry-bulb temperature due to heat of desorption of moisture from the desiccant (state Ua).

The regeneration air B which has flowed out of the desiccant wheel 103 is delivered through the path 126*a* into the heat exchanger 340, where the regeneration air B lowers its dry-bulb temperature with constant absolute humidity (state Ub).

The regeneration air B which has flowed out of the heat exchanger 340 is delivered through the path 126*b* into the first compartment 310 of the heat exchanger 300. In the first compartment 310 of the heat exchanger 300, the regeneration air B is cooled to a certain extent by the refrigerant C which is evaporated in the evaporating section 251 to lower its dry-bulb temperature and to keep its absolute humidity constant (state V). This process can be referred to as precooling because the regeneration air B is preliminary cooled before being cooled to a temperature equal to or lower than its dew point by the evaporator 210. The regeneration air B is drawn through the path 127 by the air blower 140 and discharged into the path 128. The discharged regeneration air B is delivered through the path 128 into the evaporator 210, where the regeneration air B is dehumidified and cooled to a temperature equal to or lower than its dew point, for thereby lowering its absolute humidity to 5 g/kgDA and its dry-bulb temperature to 5° C. (state P). The regeneration air B which has flowed out of the evaporator 210 repeats the same cycle.

In the heat exchanger 300, the regeneration air B is precooled by the evaporation of the refrigerant C in the evaporating section 251 and heated by the condensation of the refrigerant C in the condensing section 252. The refrigerant C evaporated in the evaporating section 251 is condensed in the condensing section 252. Thus, the evaporation and condensation of the same refrigerant C causes indirect heat exchange between the regeneration air B before being cooled by the evaporator 210 and the regeneration air B after being cooled by the evaporator 210.

In the air cycle on the psychrometric chart shown in FIG. 4, the amount of heat Q with which the regeneration air B is heated in the second compartment 320 corresponds to heating with use of waste heat, the amount of heat i with which the regeneration air B is heated by the evaporator 210 corresponds to a cooling effect, and the amount of heat recovered by the heat exchanger 300 as an economizer is represented by H. The heat exchanger 340 removes heat from the regeneration air B by the amount of heat Q1 to cool the regeneration air B. Since the regeneration air B is cooled to a certain extent by the heat exchanger 340 and then flows into the heat exchanger 300, the temperature of the regeneration air B flowing into the evaporator 210 is lowered closely to its dew point, for thereby increasing the moisture removal of the heat pump per cooling effect. The amount of heat that is discharged as a whole when the moisture in a vapor phase in the air-conditioned space is converted into a liquid phase and stored in the tank 450 and the amount of heat corresponding to the drive power of the compressor 260 can be discharged from the dehumidifying system through the heat exchanger 340 (not shown in FIG. 3).

A behavior of the refrigerant C in the evaporating sections and the condensing sections of the heat exchanger 300 will be described below with reference to FIG. 5. The refrigerant C which is reduced in pressure by the restriction 330 and which comprises a mixture of a liquid phase and a vapor phase with the refrigerant liquid being partly expanded flows into the condensing section 252A. While the refrigerant C is flowing through the condensing section 252A, the refrigerant C preheats the regeneration air B, and heat is removed from the refrigerant C itself to reduce the vapor phase of the refrigerant, and then the refrigerant C flows into the evaporating section 251A. In the evaporating section 251A, the refrigerant C cools the regeneration air B having a higher temperature than the regeneration air B in the condensing section 252A, and flows into the next evaporating section 251B while heat is applied to the refrigerant C itself to evaporate the refrigerant C in a liquid phase. While the refrigerant C is flowing through the evaporating section 251B, heat is further applied to the refrigerant C by the regeneration air B having a higher temperature to further evaporate the refrigerant C in a liquid phase. Then, the refrigerant C flows into the next condensing section 252B.

In the heat exchanger 300, as described above, the refrigerant C changes in phase between the vapor phase and the liquid phase while flowing through the refrigerant path. Thus, heat is exchanged between the regeneration air B before being cooled by the evaporator 210 and the regeneration air B which has been cooled by the evaporator 210 to lower its absolute humidity.

In the dehumidifying apparatus 21, the heat exchanger 300 is used as a precooling/preheating heat exchanger, and the operating fluid of the heat exchanger 300 and the operating fluid (i.e., the refrigerant) of the heat pump HP1 are the same. Since the process of charging the refrigerant can be shared by the heat exchanger 300 and the heat pump HP1, the cost of manufacture and the cost of maintenance of the dehumidifying apparatus 21 can be reduced. The precooling/preheating heat exchanger can be manufactured as a unitary assembly. Because the refrigerant as the operating fluid flows as the refrigerant of the heat pump in one direction through the refrigerant path, no wick is required in the heat pipe, and hence the heat exchanger can be manufactured by production facilities for producing ordinary air/refrigerant heat exchangers, which have no wick. Accordingly, the heat exchanger can be manufactured at a low cost.

A second embodiment of the present invention will be described below with reference to FIG. 6. The second embodiment differs from the first embodiment in that a heat exchanger 340*a* is used instead of the heat exchanger 340. The heat exchanger 340*a* has a structure similar to the heat exchanger 340.

The heat exchanger 340*a* has evaporating sections 341A, 341B and condensing sections 342A, 342B. The evaporating sections 341A, 341B correspond to the evaporating sections 251A, 251B of the heat exchanger 300, and the condensing sections 342A, 342B correspond to the condensing sections 252A, 252B of the heat exchanger 300. While the evaporating sections and the condensing sections are shown as being considerably spaced apart from each other, they should preferably be in the form of a group of integral thin pipes as with the heat exchanger 300.

The evaporating sections extend through a first compartment 343 and the condensing sections extend through a second compartment 344. The first compartment 343 is inserted between the desiccant wheel 103 and the first compartment 310 of the heat exchanger 300. The regeneration air B which has passed through the desiccant wheel 103 passes through the first compartment 343 of the heat exchanger 340*a,* and then flows into the first compartment 310 of the heat exchanger 300.

The second compartment 344 of the heat exchanger 340*a* is arranged such that external air is allowed to pass therethrough by an air blower 144.

The refrigerant pipe 203 extending into the condensing section 342A has a restriction 336 disposed thereon. The dehumidifying apparatus is arranged such that the heat exchanger 340*a* is inserted on the refrigerant pipe 203 according to the first embodiment as viewed along the flow of the refrigerant. The refrigerant C flows through the condensing section 342A, the evaporating section 341A, the evaporating section 341B, and the condensing section 342B, and then reaches the restriction 330. In this time, heat is transferred from the regeneration air B passing through the first compartment 343 to external air passing through the second compartment 344 by the condensation and evaporation of the refrigerant, as with the heat exchanger 300.

Figure 7:
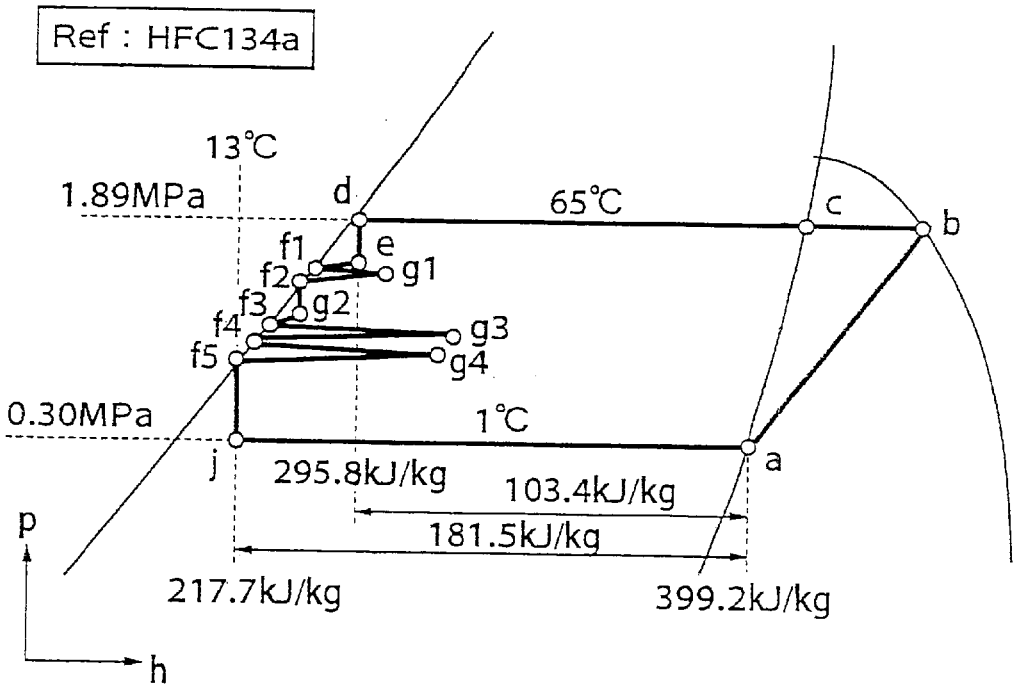
FIG. 7 is a Mollier diagram of a heat pump of the dehumidifying apparatus shown in FIG. 6.

Operation of a heat pump HP2 will be described with reference to FIG. 7. FIG. 7 is a Mollier diagram plotted in the case where HFC134a is used as the refrigerant C, as with FIG. 3. Details of operation which are the same as those described with reference to FIG. 3 will not be described below.

In FIG. 7, points a, b, c, d are the same as those shown in FIG. 3. The refrigerant liquid C in the state represented by the point d is reduced in pressure by the restriction 336 and flows into the condensing section 342A of the heat exchanger 340*a*. This state is indicated by a point "e" on the Mollier diagram. The pressure of the refrigerant is an intermediate pressure according to the present invention, and is of an intermediate value between 0.30 MPa and 1.89 MPa in the present embodiment. The intermediate pressure is higher to a certain extent than a saturated pressure at a temperature of 13° C. The refrigerant C is a mixture of the liquid and the vapor because part of the liquid is evaporated.

In the condensing section 342A, the refrigerant C is condensed under the intermediate pressure, and reaches a state represented by a point f1 on a saturated liquid curve under the intermediate pressure.

The refrigerant C in the state indicated by the point f1 flows into the evaporating section 341A. In the evaporating section 341A, the refrigerant C removes heat from the regeneration air B having a relatively high temperature and flowing through the first compartment 343, and is evaporated. The refrigerant C further flows into the evaporating section 341B, and reaches a state represented by a point g1, which is located intermediately between the saturated liquid curve and the saturated vapor curve. In the point g1, while part of the liquid is evaporated, the refrigerant liquid C remains in a considerable amount.

The refrigerant C in the state represented by the point g1 flows into the condensing section 342B, is cooled to increase its liquid phase, and reaches a state represented by a point f2 on the saturated liquid curve. The refrigerant liquid C is reduced in pressure by the restriction 330, and flows into the condensing section 252A of the heat exchanger 300. Subsequent operation is the same as the operation described above with reference to FIG. 3, and will not be described below. The points f1, g1, f2, g2, f3 shown in FIG. 3 are changed respectively to points f3, g3, f4, g4, f5 in FIG. 7. The operating temperature of the heat exchanger 300 is lowered to a certain extent from 15° C. to 13° C. because the refrigerant C is efficiently cooled by the heat exchanger 340*a*.

With the above arrangement, since the heat pump has the heat exchanger 304*a* which utilizes heat transfer by way of condensation and evaporation, the regeneration air B can be cooled with an excellent rate of heat transfer. The cooling effect of the refrigerant can further be increased.

Figure 8:
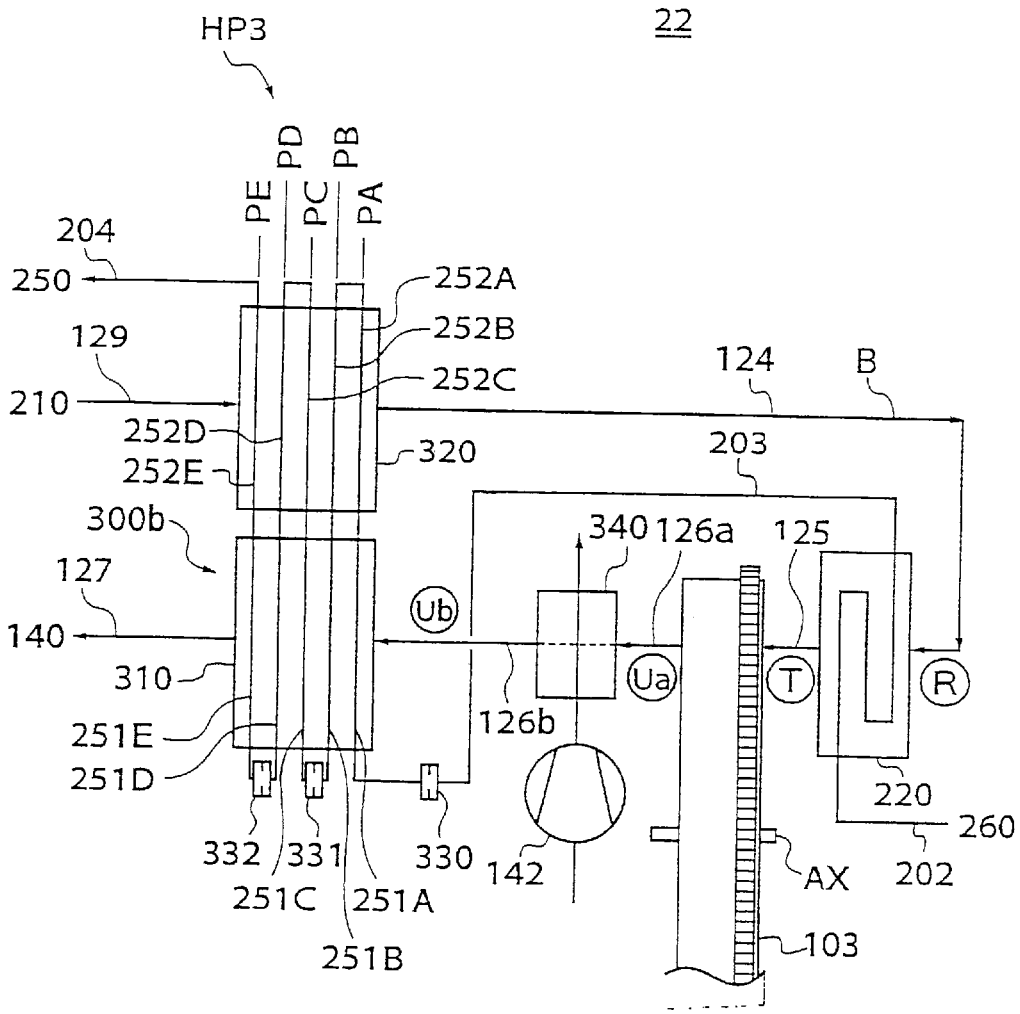
FIG. 8 is a flow diagram of major components of a dehumidifying apparatus according to a third embodiment of the present invention.
Figure 9:
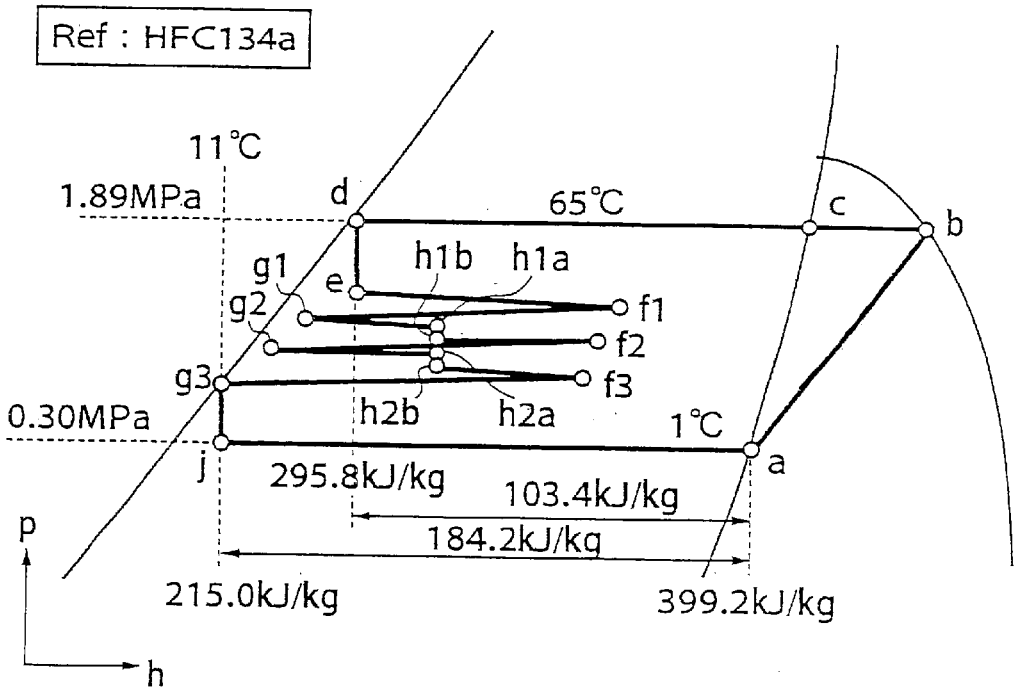
FIG. 9 is a Mollier diagram of a heat pump of the dehumidifying apparatus shown in FIG. 8.

A third embodiment of the present invention will be described below with reference to FIGS. 8 and 9. The third embodiment differs from the first embodiment shown in FIG. 1 in that the refrigerant flows from the restriction 330 first into the evaporating section 251A of a heat exchanger 300*b,* the refrigerant moves from the plane PA to the plane PB between the condensing sections 252A, 252B (the movement of the refrigerant between the other planes is successively shifted), a plane PE is added, and restrictions 331, 332 are provided between the evaporating sections in the planes PB, PC and between the evaporating sections in the planes PD, PE. Specifically, as shown in FIG. 8, the end of the evaporating section 251B in the plane PB and the end of the evaporating section 251C in the plane PC are connected to each other via the restriction 331, and the end of the evaporating section 251D in the plane PD and the end of the evaporating section 251E in the plane PE are connected to each other via the restriction 332. Other structural details are identical to those shown in FIG. 1 and are omitted from illustration.

The major change of the third embodiment from the first embodiment is the restrictions 331, 332 disposed between the planes. Other changes do not cause a significant operational change except that the evaporation and condensation in the heat exchanger 300*b* are shifted as a whole to a vapor phase because the refrigerant flows from the restriction 330 first into the evaporating section 251A. More planes than the planes PA through PE may be added, and more restrictions may be added accordingly.

In the above arrangement, the refrigerant C introduced into the evaporating section 251A is partly evaporated into a two-phase state in the evaporating section 251A, and flows into the condensing section 252A. The refrigerant changes its direction in the U tube, and flows into the condensing section 252B and the evaporating section 251B. The refrigerant is partly evaporated in the evaporating section 251B, is depressurized by the restriction 331, and flows into the evaporating section 251C in the plane PC. The refrigerant is further evaporated in the evaporating section 251C, and then flows into the condensing section 252C. The refrigerant changes its direction in the U tube, and flows into the condensing section 252D. In the condensing section 252D, the refrigerant is further condensed and then flows into the evaporating section 251D. The refrigerant C is partly evaporated in the evaporating section 251D, and reaches the restriction 332. The refrigerant is depressurized by the restriction 332, and flows into the evaporating section 251E in the plane PE and subsequently into the condensing section 252E in the plane PE. The refrigerant C is sufficiently condensed in the condensing section 252E, and flows through the path 204 to the expansion valve 250.

The evaporating pressures in the evaporating sections 251A, 251B and the condensing pressures in the condensing sections 252A, 252B, i.e., first intermediate pressures, or the pressures in the evaporating sections 251C, 251D and the condensing sections 252C, 252D, i.e., second intermediate pressures, depend on the temperature of the regeneration air B before flowing into the evaporator 210 and the temperature of the regeneration air B after flowing through the evaporator 210 and being cooled therein.

Since the heat exchanger 300 shown in FIG. 1 or the heat exchanger 300*b* shown in FIG. 8 utilizes heat transfer by way of evaporation and condensation, the heat exchanger has an excellent rate of heat transfer. Particularly, the heat exchanger 300*b* has a very high efficiency of heat exchange as it performs heat exchange of the regeneration air B on the counterflow principles as described later. Since the refrigerant C is forcibly caused to flow in a substantially one direction as a whole in the refrigerant paths, from the evaporating section 251 to the condensing section 252 or from the condensing section 252 to the evaporating section 251, the efficiency of heat exchange between the regeneration air B having a high temperature and the regeneration air B having a low temperature is very high. The expression "the refrigerant flows in a substantially one direction as a whole" means that the refrigerant C flows in a substantially one direction in the refrigerant paths when viewed as a whole even though the refrigerant may locally flow back due to turbulences or be vibrated in the flowing direction due to pressure waves produced by bubbles or instantaneous interruptions. In the present embodiment, the refrigerant C is forced to flow in one direction under the pressure increased by the compressor 260.

When the high-temperature fluid is cooled, i.e., the heat exchanger is used for cooling the high-temperature fluid, the efficiency $\phi$ of heat exchange is defined by $$\phi=(TP1-TP2)/(TP1-TC1)$$

where the temperature of the high-temperature fluid at the inlet of the heat exchanger is represented by TP1, the temperature thereof at the outlet of the heat exchanger by TP2, the temperature of the low-temperature fluid at the inlet of the heat exchanger by TC1, and the temperature thereof at the outlet of the heat exchanger by TC2. When the low-temperature fluid is to be heated, i.e., when the heat exchanger is used for heating the low-temperature fluid, the efficiency $\phi$ of heat exchange is defined by $$\phi=(TC2-TC1)/(TP1-TC1)$$

Operation of a heat pump HP3 according to the third embodiment shown in FIG. 8 will be described below with reference to FIG. 9 (FIG. 8 shows only part of components of the heat pump HP3, and FIG. 1 will be referred to for other components). In FIG. 9, the transitions from the point a to the point e are identical to the first embodiment shown in FIG. 3 and will not be described below. The refrigerant C in the state represented by the point e which flows into the evaporating section 251A in the heat exchanger 300*b* is a mixture of the liquid and the vapor with part of the liquid being evaporated under the first intermediate pressure, as described above with reference to FIG. 3.

The refrigerant C is further evaporated in the evaporating section 251A, and reaches a point f1 nearer to the saturated vapor curve in the two-phase region on the Mollier diagram. The refrigerant C in this state flows into the condensing section 252A, where the refrigerant is condensed. Then, refrigerant is reversed in direction by the U tube, flows into the condensing section 252B, is further condensed, and reaches a point g1 nearer to the saturated liquid curve though in the two-phase region. Then, the refrigerant flows into the evaporating section 251B, goes toward the saturated vapor curve within the two-phase region to reach a point h1*a*. Up to this point, the refrigerant undergoes changes substantially under the first intermediate pressure.

The refrigerant C in the state represented by the point h1*a* is depressurized by the restriction 331, and reaches a point h1*b* under the second intermediate pressure. Specifically, the refrigerant flows from the evaporating section 251B as the refrigerant path in the plane PB through the restriction 331 into the evaporating section 251C as the refrigerant path in the plane PC. This refrigerant C is evaporated under the second intermediate pressure in the evaporating section 251C, and reaches a point f2. The refrigerant is then repeatedly similarly evaporated into a vapor phase and condensed into a liquid phase alternately, and depressurized by the intermediate restriction 332 to a third intermediate pressure. Thereafter, the refrigerant C which flows through the refrigerant paths of the evaporating section 251E and the condensing section 252E reaches a point g3 on the Mollier diagram which corresponds to the point f3 in FIG. 3. On the Mollier diagram, the point g3 is on the saturated liquid curve. In this point, the refrigerant has a temperature of 11° C. and an enthalpy of 215.0 kJ/kg.

As in the case of FIG. 3, the refrigerant liquid C at the point g3 is depressurized to 0.30 MPa, which is a saturated pressure at a temperature of 1° C., by the restriction 250, and reaches a state represented by a point j. The refrigerant flows as a mixture of the refrigerant liquid C and the vapor at a temperature of 1° C. into the evaporator 210, where the refrigerant removes heat from the regeneration air B and evaporated into a saturated vapor at the state indicated by the point a on the Mollier diagram. The evaporated vapor is drawn again by the compressor 260, and thus the above cycle is repeated.

In the heat exchanger 300*b*, as described above, the refrigerant C repeatedly goes alternately through changes of vapor phase and changes of liquid phase. Since the refrigerant transfers heat by way of evaporation and condensation, the rate of heat transfer is very high, as with the heat exchanger 300 in the first embodiment.

In the heat exchanger 300*b*, the regeneration air B before being cooled in the evaporator 210 exchanges heat successively in the evaporating sections 251A, 251B, 251C, 251D, 251E in the first compartment 310. Specifically, the temperature gradient of the regeneration air B and the temperature gradient of the evaporating section 251 are in the same direction. Similarly, the regeneration air B after being cooled in the evaporator 210 exchanges heat successively in the condensing sections 252E, 252D, 252C, 252B, 252A in the second compartment 320. Specifically, the temperature gradient of the regeneration air B and the temperature gradient of the condensing section 252 are in the same direction. Thus, heat exchange is performed between the counterflows of the regeneration air B before being cooled in the evaporator 210 and the regeneration air B after being cooled in the evaporator 210. Such heat exchange, together with the heat transfer by way of evaporation and condensation, allows the heat exchanger 300*b* to achieve a very high efficiency of heat exchange.

The enthalpy difference that can be used by the evaporator 210 is remarkably larger than that in the conventional heat pump. Thus, the amount of vapor that is circulated to the compressor under the same cooling load and the required power can be reduced by 20% (1−(620.1−472.2)/(620.1−434.9)=0.20), as in the case of FIG. 3.

Operation of the dehumidifying apparatus with the heat pump HP3 will not be described below as it is qualitatively the same as described above with reference to the psychrometric chart of FIG. 4.

Figure 10:
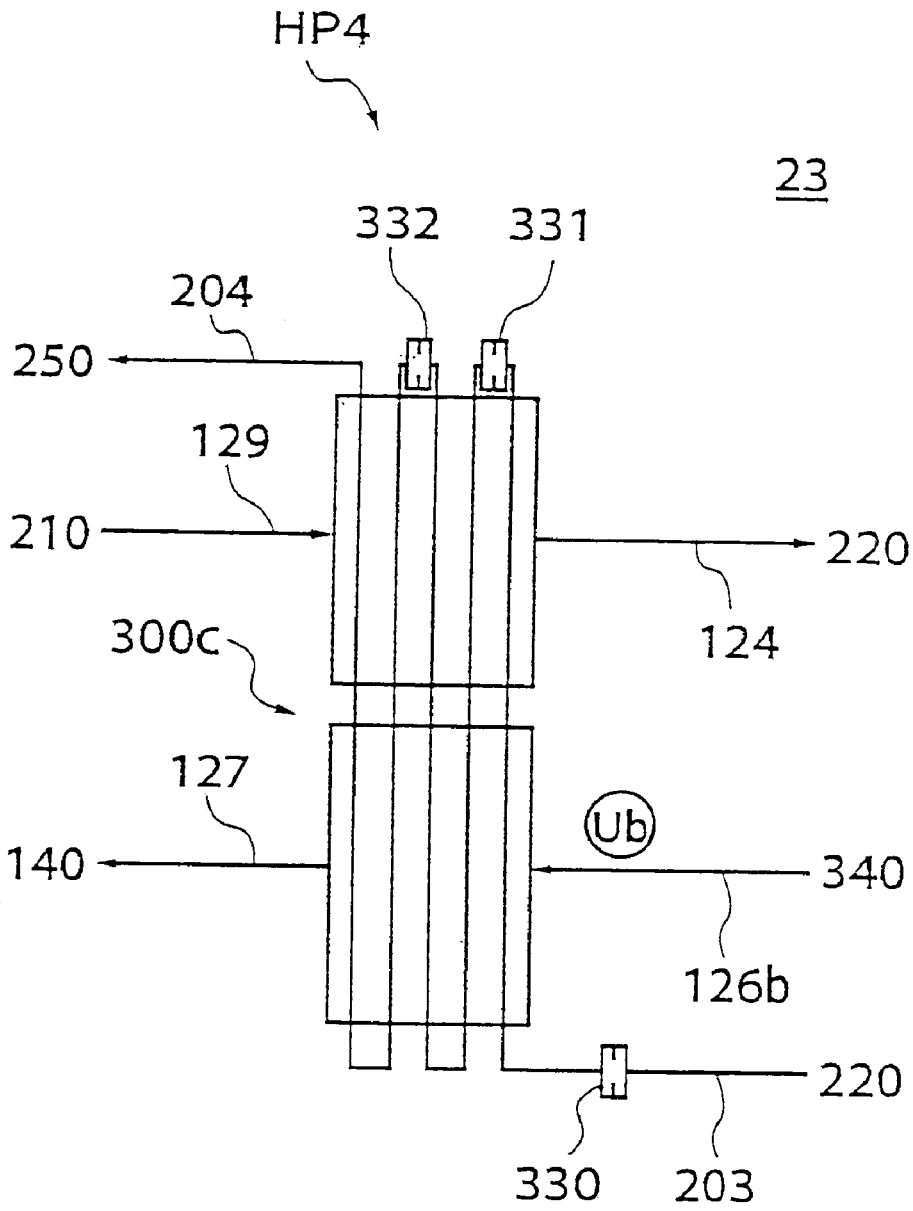
FIG. 10 is a flow diagram of a heat exchanger of a dehumidifying apparatus according to a fourth embodiment of the present invention.

FIG. 10 shows a flow diagram of a dehumidifying apparatus 23 according to a fourth embodiment of the present invention. According to the fourth embodiment, a heat exchanger 300*c,* which corresponds to the heat exchanger 300 according to the first embodiment and the heat exchanger 300*b* according to the second embodiment, has restrictions 331, 332 disposed at the condensing section 252 side. Other structural details of the fourth embodiment are identical to those of the second embodiment shown in FIG. 8.

Figure 11:
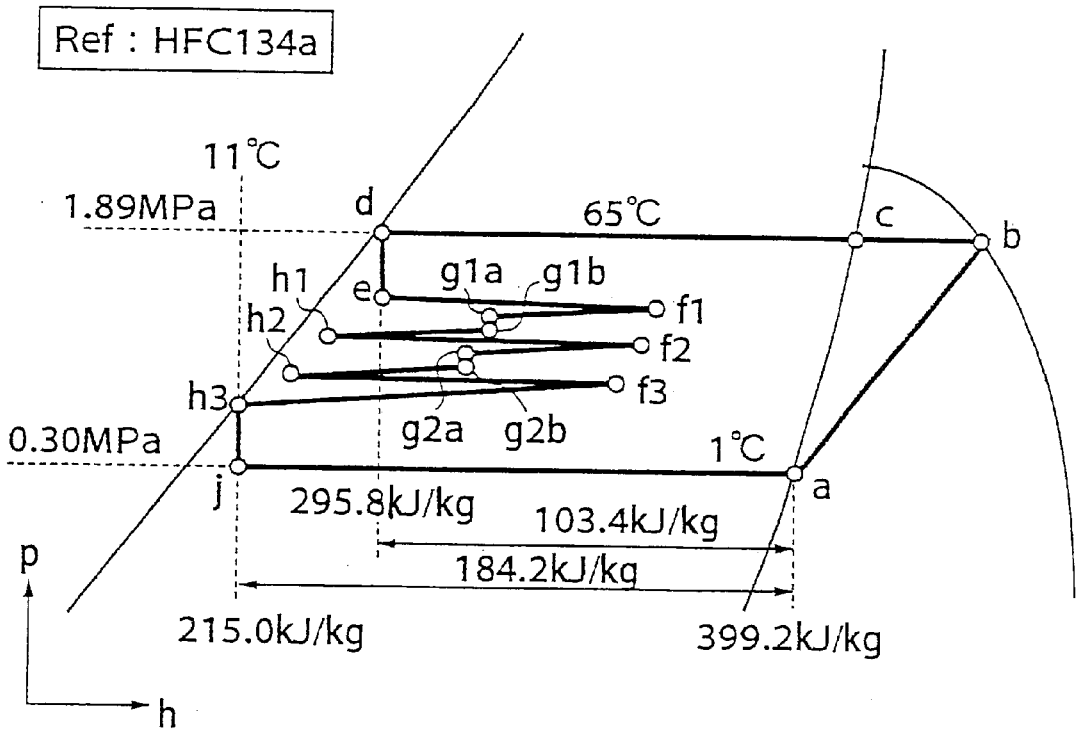
FIG. 11 is a Mollier diagram of a heat pump of the dehumidifying apparatus shown in FIG. 10.

FIG. 11 is a Mollier diagram of a heat pump HP4 shown in FIG. 10. Unlike the Mollier diagram shown in FIG. 9, the refrigerant is depressurized in the condensing process under the intermediate pressure. Specifically, the refrigerant is depressurized from a point g1*a* to a point g1*b* by the restriction 331 and depressurized from a point g2*a* to a point g2*b* by the restriction 332. The fourth embodiment is also the same as the embodiment shown in FIG. 9 in that heat exchange is performed between the counterflows of the regeneration air B before being cooled in the evaporator 210 and the regeneration air B after being cooled in the evaporator 210.

The restrictions may be provided as a combination of the restrictions shown in FIGS. 8 and 10, and disposed on both sides of the evaporating sections and the condensing sections. With this arrangement, each time the refrigerant moves from one plane to the next plane, it flows through a restriction, and the evaporating temperatures/condensing temperatures differ in each plane, so that the flows of the regeneration air between which heat is to be exchanged become nearly perfect counterflows.

Figure 6:
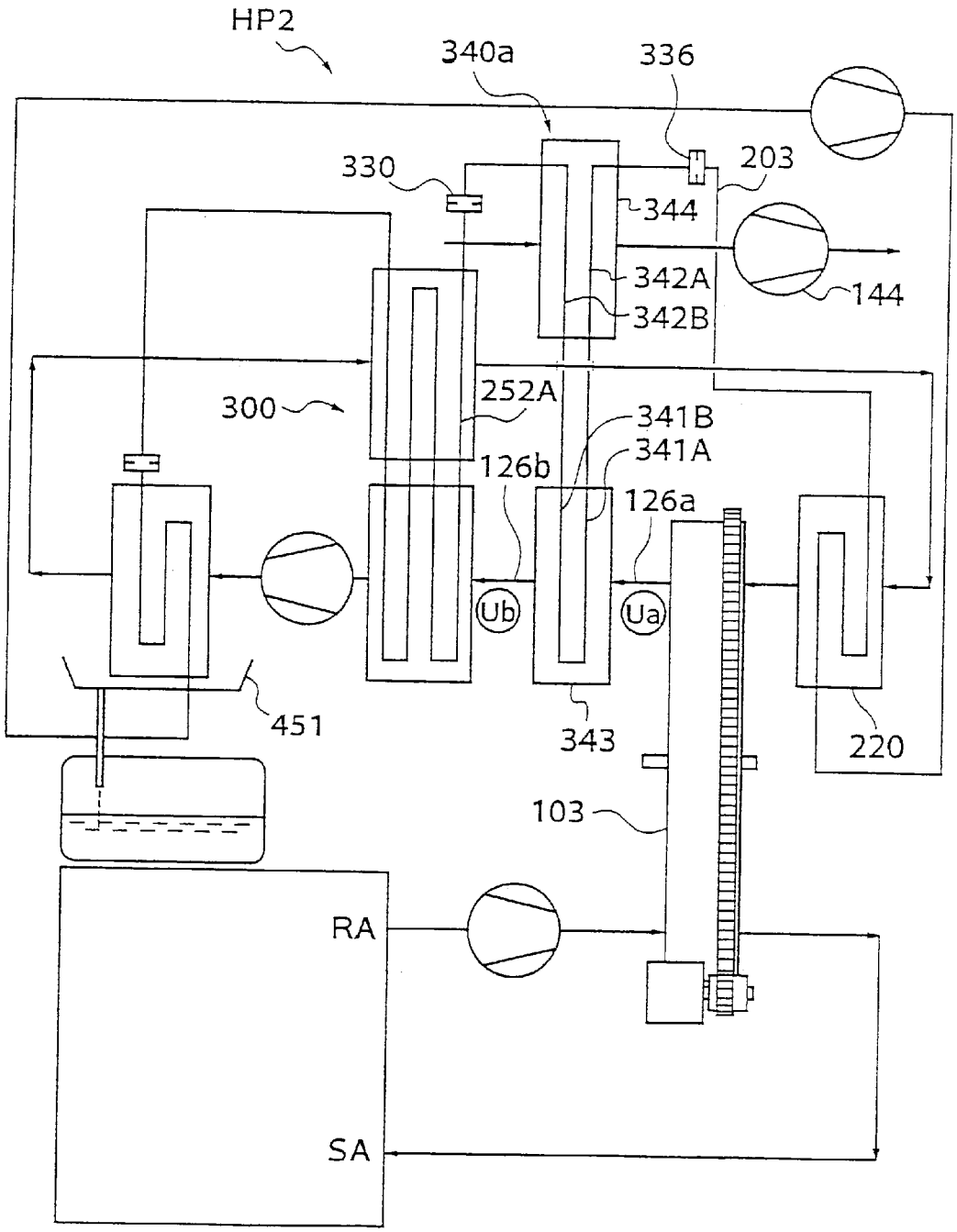
FIG. 6 is a flow diagram of a dehumidifying apparatus according to a second embodiment of the present invention.

A drain pan 451 is shown in FIGS. 1 and 6, and such a drain pan is preferably located below not only the evaporator 210, but also the heat exchangers 300, 300*b,* 300*c*. Particularly, the drain pan 451 is preferably disposed below the first compartment 310 because the regeneration air B is mainly precooled in the first compartment 310 of the heat exchangers 300, 300*b,* 300*c* and some moisture may possibly be condensed therein.

An example of a structure of the heat exchanger 300*d* according to the present invention will be described below with reference to FIGS. 12(*a*) and 12(*b*). FIG. 12(*a*) is a drawing showing the heat exchanger as viewed in the direction in which the regeneration air B having a low temperature and the regeneration air B having a high temperature are flowing, and FIG. 12(*b*) is a drawing of side elevational view showing the heat exchanger as viewed in a direction perpendicular to the flows of the low-temperature regeneration air and the high-temperature regeneration air. Specifically, FIG. 12(*a*) is a view as viewed from an arrow taken along a line A—A of FIG. 12(*b*). In FIG. 12(*a*), the high-temperature regeneration air B flows through the compartment 310 away from the viewer, and the low-temperature regeneration air B through the compartment 320 toward the viewer. In the heat exchanger 300*d,* tubes are disposed in eight rows in each of the four planes PA, PB, PC, PD which lie perpendicularly to the flows of the low-temperature regeneration air B and the high-temperature regeneration air B. Thus, the tubes are arranged in four tiers and eight rows along the flows of the regeneration air B. A plane PE, not shown, may be provided below the plane PD, and eight rows of tubes may be disposed in the plane PE. In FIGS. 1, 5, 6, 8 and 10, the heat exchange tube is disposed in one row per tier in each of the planes PA, PB, PC and PD for illustrative purpose. Typically, however, the tubes are provided in a plurality of rows per tier. In this manner, the tubes constitute a group of thin pipes.

An intermediate restriction 331 is disposed in a transitional location from the first plane PA to the next plane PB. An intermediate restriction 332 (not shown) is disposed in a transitional location from the plane PB to the plane PC. An intermediate restriction 333 is disposed in a transitional location from the plane PC to the plane PD. While one restriction is provided in a transitional location from one plane to the next, tube rows in the plane PA may be arranged in a plurality of layers. In such an arrangement, an intermediate restriction is disposed in a transitional location from each layer to the next. Planes prior and subsequent to an intermediate restriction are referred to as first and second planes.

Heat exchangers each having tubes in eight rows and four layers (tiers) as shown in FIGS. 12(*a*) and 12(*b*) may be arranged parallel to each other or in series with each other with respect to the flows of the high- and low-temperature regeneration air, depending on the amount of the regeneration air.

In the Mollier diagram shown in FIG. 11, for example, the cycle is effective even if the refrigerant C is repeatedly evaporated and condensed into a subcooled region beyond the saturated liquid curve. In view of the heat exchange between the flows of the regeneration air, however, the refrigerant C should preferably change its phase in the two-phase region. With the heat exchanger 300*d* shown in FIGS. 12(*a*) and 12(*b*), therefore, the heat transfer area of the first evaporating section connected to the restriction 330 should preferably be larger than the heat transfer area of the succeeding evaporating section. Furthermore, since the refrigerant C flowing into the restriction 250 is preferably in the saturated or subcooled region, the heat transfer area of the condensing section connected to the restriction 250 should preferably be larger than the heat transfer area of the prior condensing section.

The heat exchanger according to the present invention is inexpensive and economical when being used instead of expensive heat pipes. Unlike heat pipes, the heat exchanger according to the present invention can be maintained with little effort because it can use the same operating fluid as in the heat pump.

Figure 13:
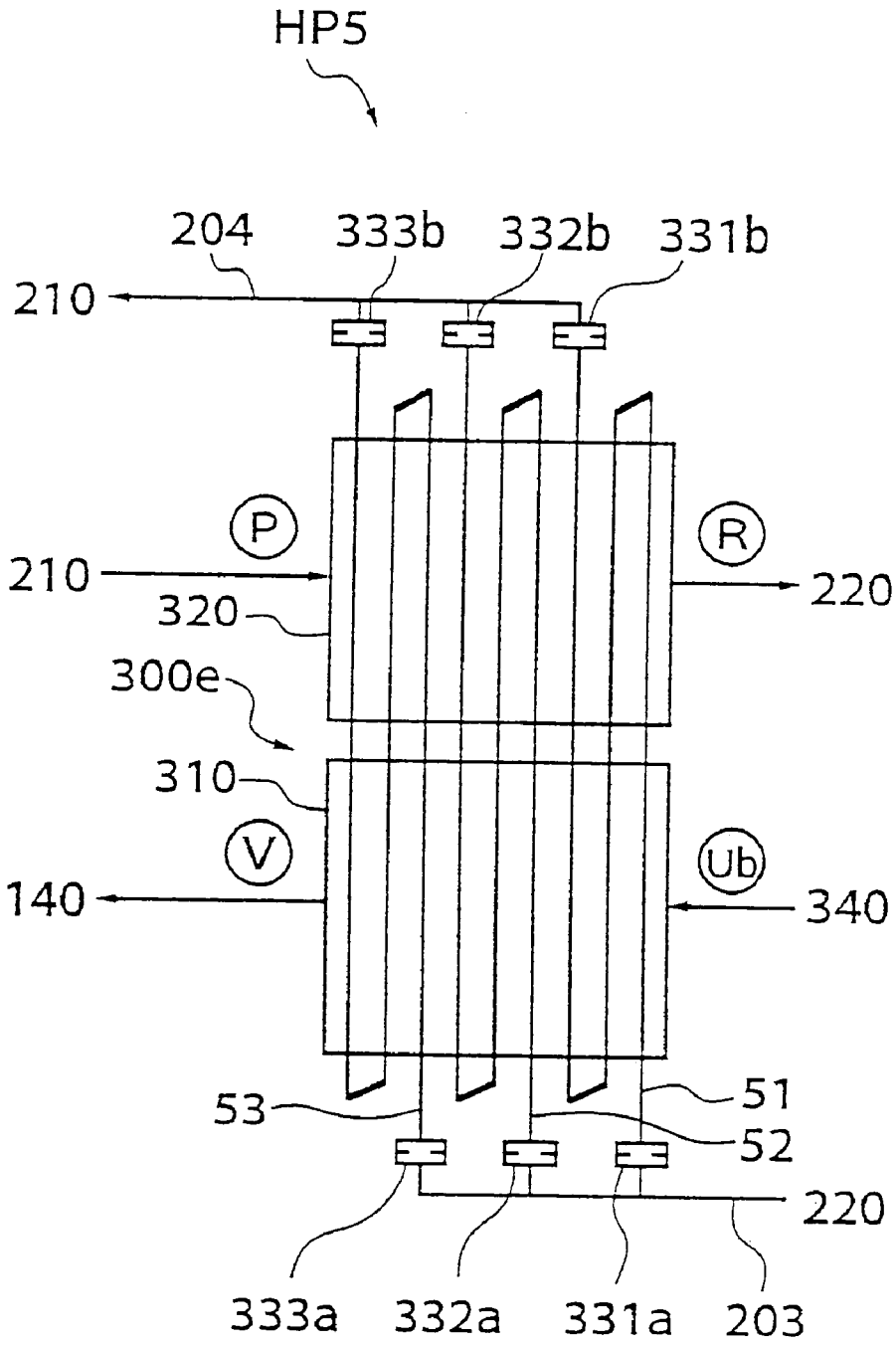
FIG. 13 is a flow diagram of a heat exchanger of a dehumidifying apparatus according to a fifth embodiment of the present invention.
Figure 14:
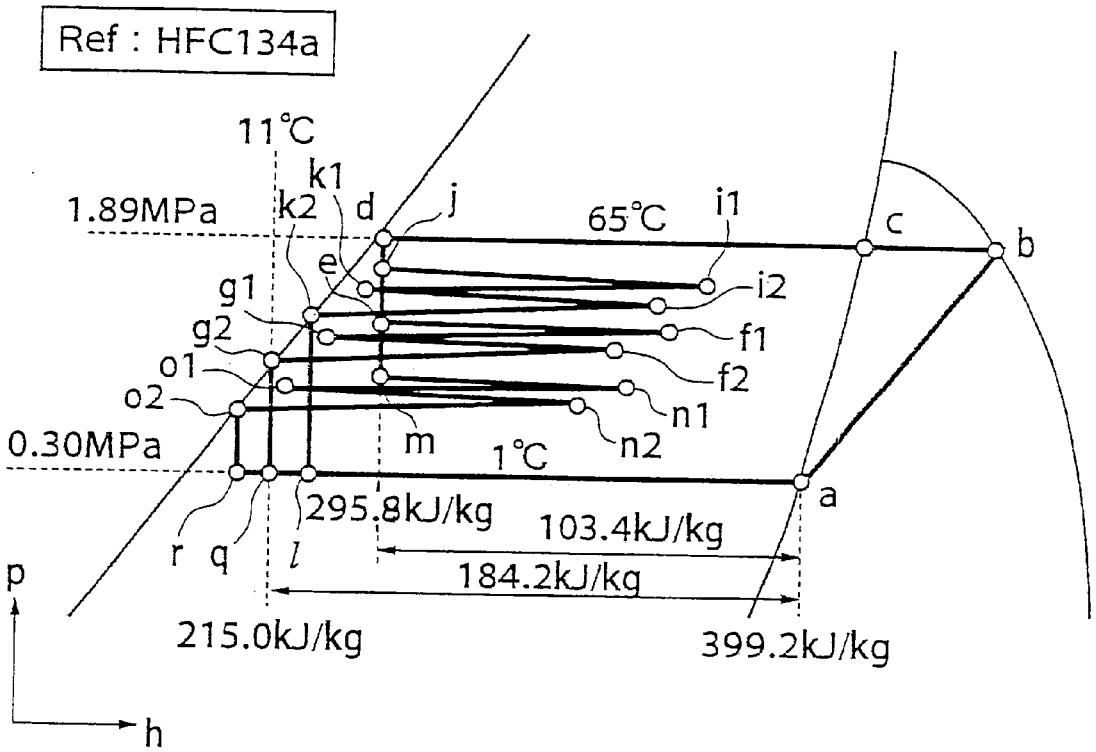
FIG. 14 is a Mollier diagram of a heat pump of the dehumidifying apparatus shown in FIG. 13.

A dehumidifying apparatus according to a fifth embodiment of the present invention will be described below with reference to FIGS. 13 through 15. FIG. 13 is a flow diagram showing flows in the dehumidifying apparatus according to the fifth embodiment, and FIG. 14 is a Mollier diagram of the refrigerant in a heat pump HP5 included in the dehumidifying apparatus shown in FIG. 13. In FIG. 13, a heat exchanger 300*e* and refrigerant and air paths connected thereto are shown, and other details are omitted from illustration. The fifth embodiment differs from the third embodiment shown in FIG. 8 in that the heat exchanger 300*b* according to the third embodiment shown in FIG. 8 is replaced with the heat exchanger 300*e*. Those parts or elements of the fifth embodiment which operates in the same manner or has the same functions as those of the third embodiment are denoted by the identical reference characters, and those parts or elements of the fifth embodiment which will not be described below are the same as those of the third embodiment.

In the present embodiment, the refrigerant path is branched into a plurality of paths (three paths in FIG. 13) downstream of the condenser 220, i.e., branched refrigerant paths 51 through 53, unlike the other embodiments. The branched refrigerant paths 51 through 53 are joined into a single refrigerant path 204 upstream of the evaporator 210. Specifically, a plurality of branched refrigerant paths are provided between the condenser 220 and the evaporator 210, and a first heat exchanging means and a second heat exchanging means are disposed in the branched refrigerant paths.

In other words, the dehumidifying apparatus according to the fifth embodiment has a plurality of thin pipe groups 51 (52, 53) connected to the condenser 220 through the first restrictions 331*a* (332*a*, 333*a*) and alternatively extending through the first compartment 310 and the second compartment 320 repeatedly and then connected to the evaporator 210 through corresponding second restrictions 331*b* (332*b*, 333*b*), and a plurality of combinations of the first restrictions 331*a*, 332*a*, 333*a* and the second restrictions 331*b*, 332*b*, 333*b* which correspond respectively to the thin pipe groups 51, 52, 53.

The branched refrigerant paths 51 through 53 alternately extend through a first heat exchanging portion (first compartment) 310 and a second heat exchanging portion (second compartment) 320 of the heat exchanger 300*e* repeatedly. The branched refrigerant paths 51 through 53 have the restrictions 331*a* through 333*a* upstream of the first heat exchanging portion 310 and the restrictions 331*b* through 333*b* downstream of the second heat exchanging portion 320. These restrictions 331*a* through 333*b* may comprise orifices, capillary tubes, expansion valves, or the like, for example.

The first compartment 310 and the second compartment 320 are arranged such that the regeneration air flows as counterflows in the respective compartments 310, 320. In the first compartment 310, the refrigerant paths 51, 52, 53 are arranged in the order named in the downstream direction of the regeneration air. In the second compartment 320, the refrigerant paths 51, 52, 53 are arranged in the order named in the upstream direction of the regeneration air.

Figure 15:
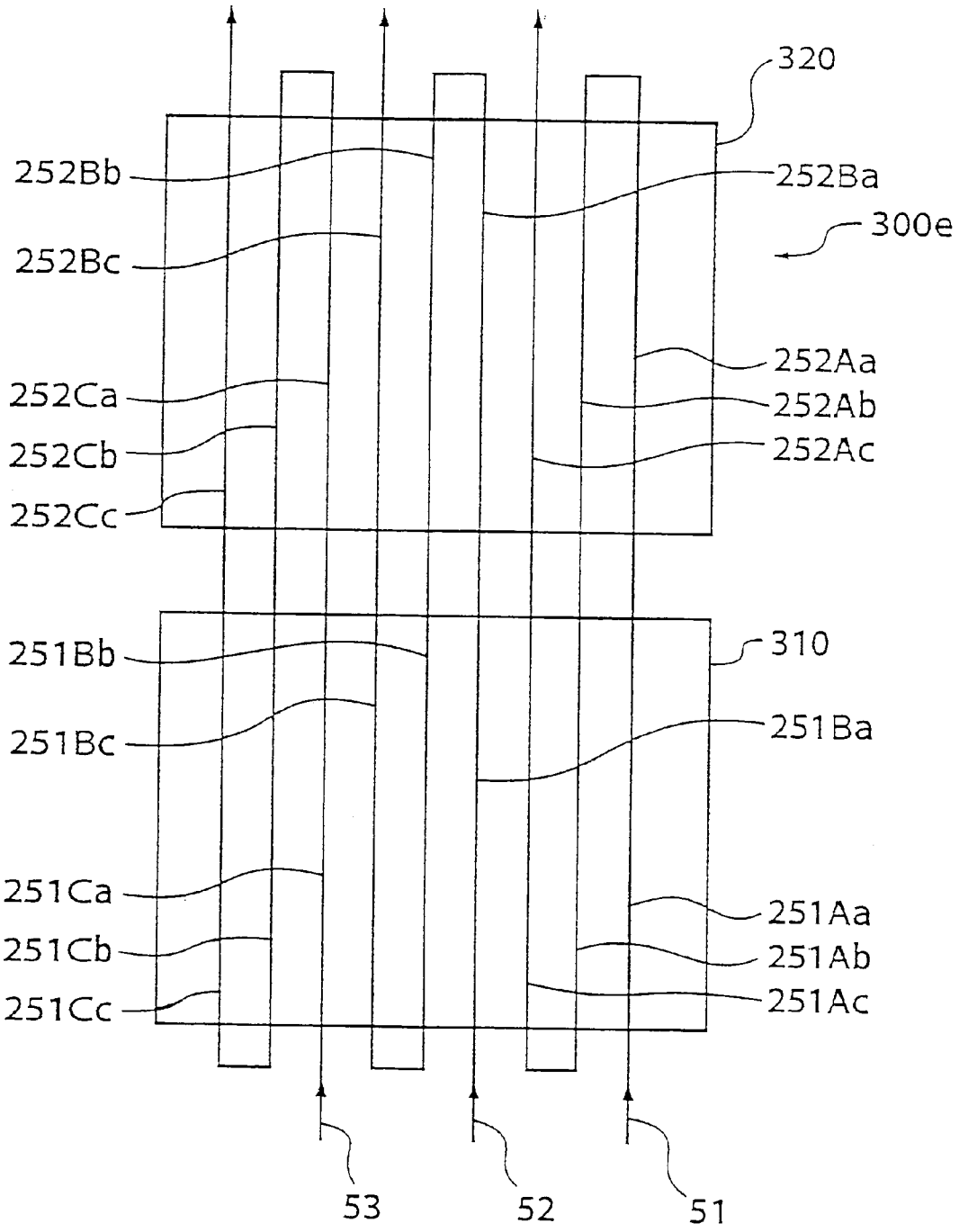
FIG. 15 is an enlarged plan view schematically showing a heat exchanger shown in FIG. 13.

FIG. 15 is an enlarged view showing the branched refrigerant paths 51 through 53 in the heat exchanger 300*e* in the dehumidifying apparatus shown in FIG. 13. The branched refrigerant paths 51 through 53 extend through the first heat exchanging portion 310 and the second heat exchanging portion 320. As shown in. FIG. 15, the branched refrigerant path 51 has an evaporating section 251A*a*, a condensing section 252A*a*, a condensing section 252A*b*, an evaporating section 251A*b*, an evaporating section 251A*c*, and a condensing section 252A*c* arranged successively from the condenser 220. Similarly, the branched refrigerant path 52 has an evaporating section 251B*a*, a condensing section 252B*a*, a condensing section 252B*b*, an evaporating section 251B*b*, an evaporating section 251B*c*, and a condensing section 252B*c*, and the branched refrigerant path 53 has an evaporating section 251C*a*, a condensing section 252C*a*, a condensing section 252C*b*, an evaporating section 251C*b*, an evaporating section 251C*c*, and a condensing section 252C*c*.

In FIG. 14, the behavior of the refrigerant from the point a to the point d is the same as the behavior of the refrigerant in the third embodiment shown in FIG. 9, and will not be described below. The refrigerant liquid which has been cooled in the condenser 220 and has reached the state represented by the point d is branched into the branched refrigerant paths 51 through 53 and flows into the heat exchanger 300*e*. First, the refrigerant flowing through the refrigerant path 52 will be described below. The refrigerant liquid flowing into the refrigerant path 52 is depressurized by the restriction 332*a* and flows into the evaporating section 251B*a* of the first heat exchanger 310. This state of the refrigerant is indicated by a point e, and the refrigerant is a mixture of the liquid and the vapor because part of the liquid is evaporated. At this time, the pressure of the refrigerant is an intermediate pressure between the condensing pressure in the condenser 220 and the evaporating pressure in the evaporator 210, i.e., is of an intermediate value between 1.89 MPa and 0.30 MPa in the present embodiment.

In the evaporating section 251B*a*, the refrigerant liquid is evaporated under the intermediate pressure, and reaches a state represented by at a point f1 which is located intermediately between a saturated liquid curve and a saturated vapor curve, under the intermediate pressure. In the point f1, while part of the liquid is evaporated, the refrigerant liquid C remains in a considerable amount. The refrigerant in the state represented by the point f1 flows into the condensing sections 252B*a*, 252B*b*. In the condensing sections 252B*a*, 252B*b*, heat is removed from the refrigerant by low-temperature air in the state at a point P which flows through the second heat exchanger 320, and the refrigerant reaches a state represented by a point g1.

The refrigerant in the state represented by the point g1 flows into the evaporating sections 251B*b*, 251B*c*, where heat is removed from the refrigerant. The refrigerant increases its liquid phase and reaches a state represented by a point f2. Then, the refrigerant flows into the condensing section 252B*c*, where the refrigerant increases its liquid phase and reaches a state represented by a point g2. On the Mollier diagram, the point g2 is on the saturated liquid curve. In this point, the refrigerant has a temperature of 11° C. and an enthalpy of 215.0 kJ/kg.

The refrigerant liquid at the point g2 is depressurized to 0.30 MPa, which is a saturated pressure at a temperature of 1° C., by the restriction 332*b*, and reaches a state represented by a point q. The refrigerant at the point q flows as a mixture of the refrigerant liquid and the vapor at a temperature of 1° C. into the evaporator 210, where the refrigerant removes heat from air in the state at a point V, and is evaporated into a saturated vapor at the state represented by the point a. The saturated vapor is drawn again by the pressurizer 260, and thus the above cycle is repeated.

In the same manner as described above, the refrigerant flowing into the refrigerant path 51 passes through the restriction 331*a*, the evaporating sections, the condensing sections, and the restriction 331*b*, goes through states represented by points j, i1, k1, i2, k2, and reaches a state represented by a point l. The refrigerant flowing through the refrigerant path 53 passes through the restriction 333*a*, the evaporating sections, the condensing sections, and the restriction 333*b*, goes through states represented by points m, n1, o1, n2, o2, and reaches a state represented by a point r.

In the heat exchanger 300*e*, as described above, the refrigerant goes through changes of the evaporated state from the point e to the point f1 or from the point g1 to the point f2 in the evaporating sections, and goes through changes of the condensed state from the point f1 to the point g1 or from the point f2 to the point g2 in the condensing sections. Since the refrigerant transfers heat by way of evaporation and condensation, the rate of heat transfer is very high and the efficiency of heat exchanger is high.

In the vapor compression type heat pump HP5 including the pressurizer 260, the condenser 220, the restrictions 331*a* through 333*b*, and the evaporator 210 (other details than the heat exchanger 300*e* and the refrigerant and air paths are omitted from illustration in FIG. 13), when the heat exchanger 300*e* according to the present invention is provided, the amount of vapor that is circulated to the pressurizer under the same cooling load and the required power can remarkably be reduced as with the third embodiment. Thus, the heat pump can perform the same operation as with a subcooled cycle. With the dehumidifying apparatus according to the present invention, since the enthalpy of the refrigerant at the inlet of the evaporator 210 is reduced due to the economizer effect of the heat pump HP5 and the cooling effect of the refrigerant per unit flow rate is high, the moisture removal effect and the energy efficiency are increased.

While the embodiments of the present invention have been described above, the present invention is not limited to the above embodiments, but may be carried out in various different forms with the scope of the technical ideas thereof. For example, the number of evaporating sections in the first heat exchanging portions in the refrigerant paths and the number of condensing sections in the second heat exchanging portions in the refrigerant paths are not limited to the illustrated examples. The number of the branched refrigerant paths in the fifth embodiment is not limited to the illustrated example, but the refrigerant path may be branched into any number of branched refrigerant paths.

Structural details of the desiccant wheel 103 for use in the embodiments of the present invention will be described below with reference to FIG. 16. The desiccant wheel 103 comprises a thick disk-shaped wheel which is rotatable about a rotational axis AX, and a desiccant is filled into the wheel with gaps for allowing a gas to pass therethrough. For example, the desiccant wheel 103 comprises a number of tubular dry elements bounded to each other so that their central axes extend parallel to the rotational axis AX. The wheel is arranged so as to rotate in one direction about the rotational axis AX and also to allow the process air A and the regeneration air B to flow into and out of the desiccant wheel 103 parallel to the rotational axis AX. Each of the dry elements is positioned so as to alternately contact the process air A and the regeneration air B according to rotation of the desiccant wheel 103. Generally, the desiccant wheel 103 is arranged so that the process air A and the regeneration air B flow as counterflows parallel to the rotational axis AX through respective substantially half areas of the circular desiccant wheel 103.

Figure 16:
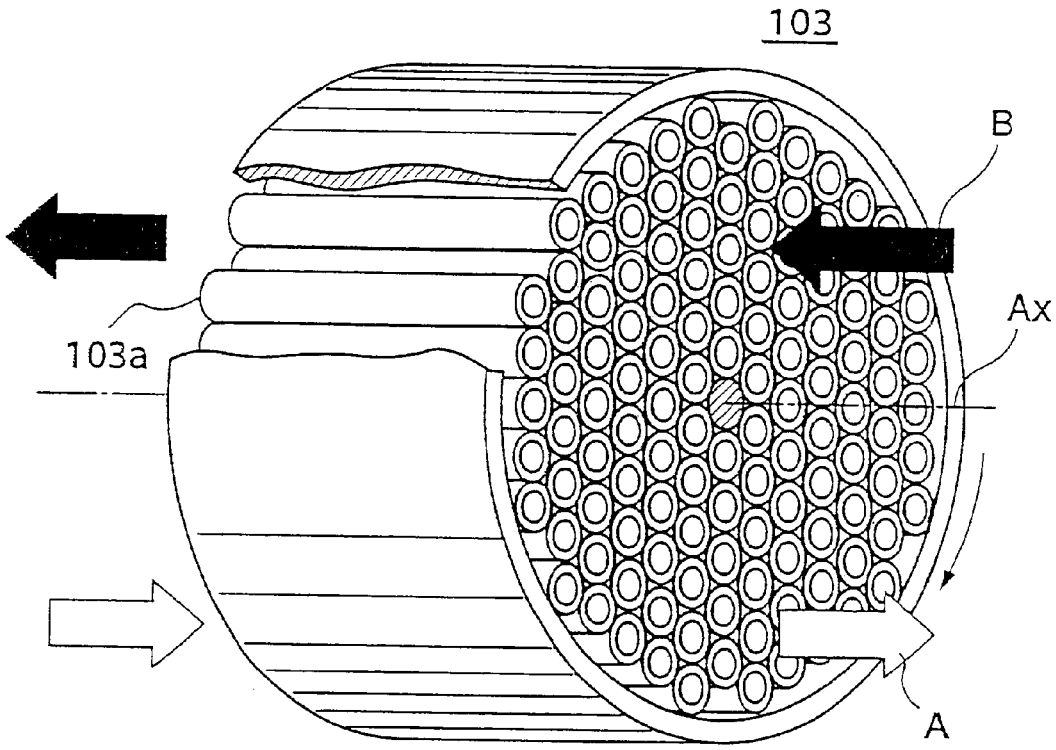
FIG. 16 is a perspective view, partly cut away, showing a structure of a typical desiccant wheel for use in the dehumidifying apparatus according to the embodiment of the present invention.
Figure 17:
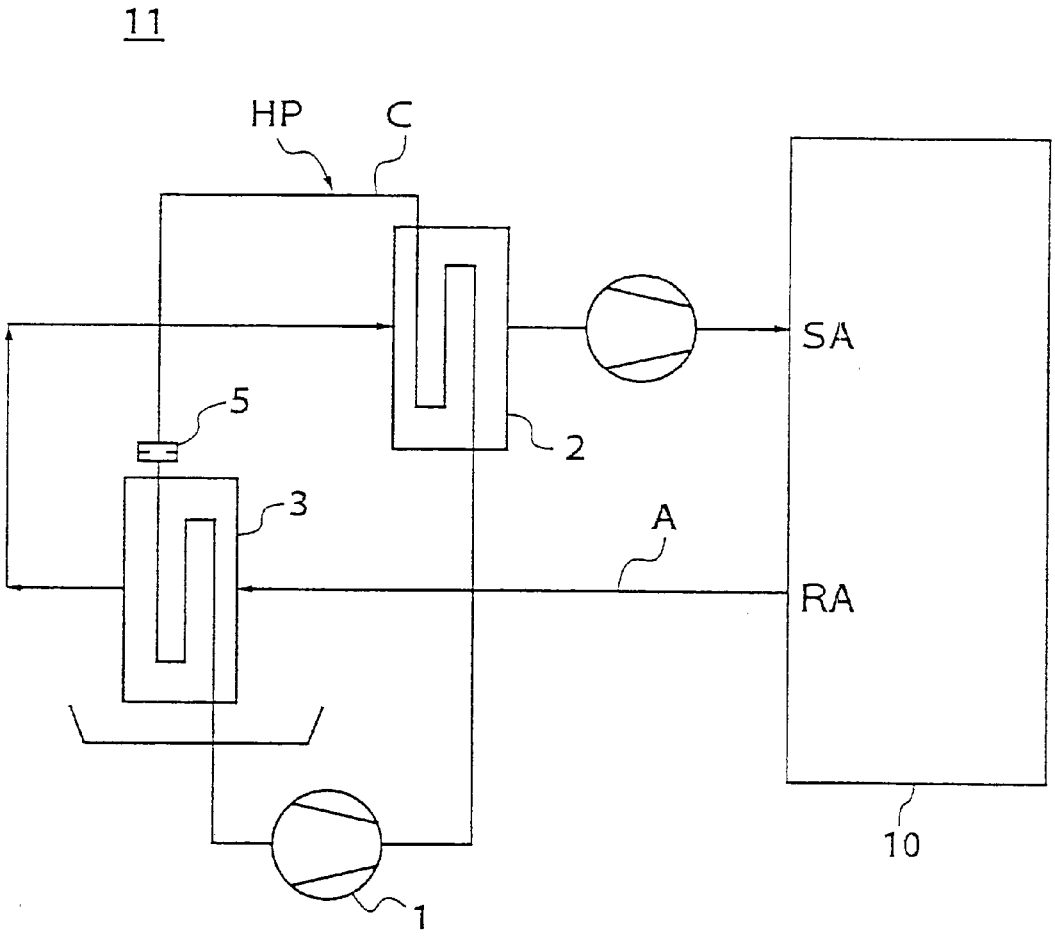
FIG. 17 is a flow diagram of a conventional dehumidifying air-conditioning apparatus.

The region through which the process air A flows and the region through which the regeneration air B flows are separated from each other by a partition plate (not shown in FIG. 16). The desiccant wheel 103 rotates across the partition plate to bring the dry elements 103*a* into alternate contact with the process air A and the regeneration air B. In FIG. 16, the wheel is shown as being partly cut away to illustrate the dry elements 103*a* clearly.

The desiccant may be filled in the tubular dry elements as described above. The desiccant wheel 103 is arranged to allow the process air A and the regeneration air B to flow across the disk-shaped rotor.

In the embodiments described above, the same refrigerant C is used as a heat transfer medium in the evaporator 210 for cooling the regeneration air B to a temperature equal to or lower than its dew point, the first compartment 310 of the heat exchangers 300, 300*b*, 300*c*, 300*d*, 300*e* for precooling the regeneration air B, the condenser 220 for heating the regeneration air B, and the second compartment 320 of the heat exchangers 300, 300*b*, 300*c*, 300*d*, 300*e* for preheating the regeneration air B. Therefore, the refrigerant system is simplified. The refrigerant is positively circulated because the pressure difference between the evaporator 210 and the condenser 220 can be utilized. Since a boiling phenomenon with a phase change is applied to heat exchanges for precooling and preheating the process air, a high efficiency can be achieved.

The dehumidifying apparatus according to the above embodiments has been described as the dehumidifying apparatus for dehumidifying an air-conditioned space. However, the dehumidifying apparatus according to the present invention is applicable not only to the air-conditioned space, but also to other spaces that need to be dehumidified.

Industrial Applicability

According to the present invention, as described above, a dehumidifying apparatus comprises a moisture adsorbing device for removing moisture from process air and for being regenerated by desorbing moisture therefrom with regeneration air; and a heat pump having a condenser for condensing a refrigerant to heat said regeneration air at the upstream side of said moisture adsorbing device, an evaporator for evaporating said refrigerant to cool said regeneration air to a temperature equal to or lower than its dew point at the downstream side of said moisture adsorbing device, a pressurizer for raising a pressure of said refrigerant evaporated by said evaporator and delivering said refrigerant to said condenser, and a first heat exchanger for exchanging heat between said regeneration air flowing between said moisture adsorbing device and said evaporator and the regeneration air flowing between said evaporator and said condenser; wherein said regeneration air is used in circulation. Therefore, the regeneration air can be precooled by the heat exchanging means prior to cooling in the evaporator, and the amount of heat removed in the precooling process can be recovered from the regeneration air which has been cooled by the evaporator. Thus, a dehumidifying apparatus having a heat pump with a high coefficient of performance can be provided, and it is possible to provide a dehumidifying apparatus which consumes a small amount of energy per amount of moisture removal.

The moisture of the process air is not removed by being cooled by the evaporator, but is removed by the moisture adsorbing device. Therefore, it is possible to obtain air having a low dew point equal to or lower than an freezing point, i.e., a low absolute humidity of 4 g/kgDA or lower.

What is claimed is:

1. A dehumidifying apparatus comprising:

a moisture adsorbing device for removing moisture from process air and for being regenerated by desorbing moisture therefrom with regeneration air; and a heat pump having a condenser for condensing a refrigerant to heat said regeneration air at the upstream side of said moisture adsorbing device, an evaporator for evaporating said refrigerant to cool said regeneration air to a temperature equal to or lower than its dew point at the downstream side of said moisture adsorbing device, a pressurizer for raising a pressure of said refrigerant evaporated by said evaporator and delivering said refrigerant to said condenser, and a first heat exchanger for exchanging heat between said regeneration air flowing between said moisture adsorbing device and said evaporator and the regeneration air flowing between said evaporator and said condenser;

wherein said regeneration air is used in circulation.

2. A dehumidifying apparatus according to claim 1, wherein said first heat exchanger comprises a thin pipe group connecting said condenser and said evaporator to each other, for passing said refrigerant therethrough;

wherein said thin pipe group is arranged so as to introduce said refrigerant condensed by said condenser to said evaporator and also to bring said refrigerant into alternate contact with said regeneration air flowing between said moisture adsorbing device and said evaporator and said regeneration air flowing between said evaporator and said condenser.

3. A dehumidifying apparatus according to claim 2, wherein said first heat exchanger has a first compartment for passing said regeneration air between said moisture adsorbing device and said evaporator, and a second compartment for passing said regeneration air between said evaporator and said condenser, said thin pipe group being connected to said condenser through a first restriction, extending alternately through said first compartment and said second compartment repeatedly, and then being connected to said evaporator through a second restriction.

4. A dehumidifying apparatus according to claim 3, further comprising a plurality of thin pipe groups connected to said condenser through said first restrictions and alternately extending through said first compartment and said second compartment repeatedly and then connected to said evaporator through said corresponding second restrictions, and a plurality of combinations of said first restrictions and said second restrictions which correspond respectively to the thin pipe groups.

5. A dehumidifying apparatus according to claim 3, wherein said first compartment and said second compartment are arranged such that said regeneration air flows as counterflows in the respective compartments; and said thin pipe groups in said first compartment and said second compartment have at least a pair of a first compartment extending portion and a second compartment extending portion in a first plane which is substantially perpendicular to the flow of said regeneration air, at least a pair of a first compartment extending portion and a second compartment extending portion in a second plane, different from said first plane, which is substantially perpendicular to the flow of said regeneration air, and an intermediate restriction disposed in a transitional location from said first plane to said second plane.

6. A dehumidifying apparatus according to any one of claims 1 through 5, further comprising a second heat exchanger disposed in a passage of the regeneration air used in circulation, for exchanging heat between said regeneration air and another fluid.

7. A dehumidifying apparatus according to claim 6, wherein said second heat exchanger comprises a second thin pipe group connecting said condenser and said first heat exchanger to each other, for passing the refrigerant therethrough; and said second thin pipe group is arranged so as to introduce said refrigerant condensed by said condenser to said first heat exchanger and also to bring said refrigerant into alternate contact with said regeneration air flowing between said moisture adsorbing device and said first heat exchanger and the other fluid.

8. A dehumidifying apparatus according to claim 6, wherein said other fluid comprises external air.

* * * * *